US008905514B1

(12) United States Patent
Kishigami et al.

(10) Patent No.: US 8,905,514 B1
(45) Date of Patent: Dec. 9, 2014

(54) LIQUID EJECTING APPARATUS

(71) Applicant: Seiko Epson Corporation, Tokyo (JP)

(72) Inventors: Minoru Kishigami, Matsumoto (JP); Kazutoshi Matsuzaki, Shiojiri (JP); Daisuke Tanaka, Shiojiri (JP); Shota Mizuno, Tatsuno (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/255,184

(22) Filed: Apr. 17, 2014

(30) Foreign Application Priority Data

Jun. 13, 2013 (JP) ..... 2013-124877

(51) Int. Cl.
*B41J 2/165* (2006.01)
*B41J 23/00* (2006.01)

(52) U.S. Cl.
CPC ..... *B41J 2/16511* (2013.01)
USPC ..... 347/29; 347/32; 347/37

(58) Field of Classification Search
CPC ..... B41J 2/16585; B41J 2/16511; B41J 2/16505; B41J 2/16508; B41J 2/16547; B41J 2/16523; B41J 19/202; B41J 25/308; B41J 25/34; B41J 2/1752; B41J 19/005; B41J 25/304
USPC ..... 347/32, 37, 29
See application file for complete search history.

(56) References Cited

U.S. PATENT DOCUMENTS

2008/0165219 A1* 7/2008 Inoue ..... 347/29
2013/0050333 A1 2/2013 Tanaka et al.

FOREIGN PATENT DOCUMENTS

JP 2005-254771 9/2005
JP 2009-034821 2/2009
JP 2013-049201 3/2013
JP 2013-052610 3/2013

* cited by examiner

*Primary Examiner* — Lisa M Solomon
(74) *Attorney, Agent, or Firm* — Workman Nydegger

(57) ABSTRACT

Provided is a liquid ejecting apparatus including a main body frame that has a main guiding member which has a sliding surface and enables a carriage to move in a scanning direction in a state where the carriage is mounted thereon, and a slide body which has a cap member which can abut on a liquid ejecting head to surround nozzles in such a manner that the slide body moves along with the carriage in a state where an abutment portion which can abut on the carriage abuts on the carriage, in which the carriage has a connection portion in which the carriage is connected to a movement mechanism which moves the carriage in the scanning direction.

6 Claims, 17 Drawing Sheets

LIQUID EJECTING APPARATUS

BACKGROUND

1. Technical Field

The present invention relates to a liquid ejecting apparatus, such as an ink jet type printer.

2. Related Art

Generally, an ink jet type printer has been widely known as a liquid ejecting apparatus which ejects liquid onto a target object. Such an ink jet type printer performs printing in such a manner that a liquid ejecting head supported by a carriage (a movable body) which reciprocates in a scanning direction ejects ink (liquid) onto a paper sheet (a target object) through nozzles. A certain type of printer adjusts a distance between a liquid ejecting head and a paper sheet, when performing printing, in such a manner that a vertical position of a carriage is adjusted in accordance with a thickness of the paper sheet.

In this type of printer, a certain printer is configured such that a movement guiding member which extends in a scanning direction and has a sliding surface is installed in a fixed manner and a carriage reciprocates in the scanning direction in a state where the carriage is mounted on the sliding surface. In addition, a so-called capping operation in which a cap member abuts on the liquid ejecting head so as to surround nozzles is performed to prevent printing failure which is caused by ink in nozzles, which has dried during a non-printing period, such as a non-operation period.

In other words, a printer includes a cap member (a cap) which can abut (come into contact with) on a liquid ejecting head which is supported on a lower surface of a carriage so as to surround nozzles. The cap member is provided on a slide body (an interlocking portion) which moves, in a sliding manner, along with the carriage in a scanning direction in such a manner that the carriage which moves, along a movement guiding member (a guide rail), on a sliding surface in the scanning direction abuts on the slide body. The cap member is configured such that, in accordance with a sliding movement of the slide body, the cap member moves (moves in a vertical direction) between a retreated position in which the cap member does not abut on the liquid ejecting head during a printing period and an abutment position (a contact position) in which the cap member abuts on the liquid ejecting head during the non-printing period (see JP-A-2009-34821, for example).

To change the vertical position of the carriage to adjust the distance between the liquid ejecting head and the paper sheet, a printer described above is generally configured such that the carriage can move, on the sliding surface, in an up and down direction substantially perpendicular to the sliding surface. Furthermore, a moving force is applied to the carriage in such a manner that a driving belt connected to a part of the carriage moves. Meanwhile, the cap member that abuts on the liquid ejecting head which is supported on the lower surface of the carriage is located lower than the liquid ejecting head, and thus the slide body having the cap member abuts on the carriage, normally at a position lower than a connection portion between the carriage and the driving belt.

In the printer, when the capping operation is performed, a moving force of the carriage by the driving belt and a reaction force of the slide body, which is caused by abutting of the slide body on the carriage, are applied to the carriage, in an opposite direction. Therefore, a turning force is generated in the carriage. In this case, a position in which the moving force is applied to the connection portion is located more apart from the sliding surface than the abutment position in which the reaction force is applied to the carriage, and thus the generated turning force acts to cause the carriage to be separated from the sliding surface. As a result, a part of the carriage which can move, on the sliding surface, in the up and down direction is separated from the sliding surface, and thus a posture of the carriage inclines. Therefore, when moving the carriage, in the scanning direction, to a reference position of the carriage, in which, for example, the capping operation is performed, there is a problem in that the carriage cannot accurately move to the reference position due to the inclined posture of the carriage.

This problem is not limited to an ink jet type printer. In other words, the problem described above is mainly common to a liquid ejecting apparatus in which a cap member abuts on the liquid ejecting head in such a manner that a slide body which is mounted on a sliding surface and which has a cap member that abuts on a liquid ejecting head supported by a movable body that can move along the sliding surface abuts on the movable body in a moving state and thus moves along with the movable body.

SUMMARY

An advantage of some aspects of the invention is to provide a liquid ejecting apparatus in which, when a movable body on which a liquid ejecting head is supported moves a slide body having a cap member in a scanning direction, the movable body can stably move without being separated from a sliding surface.

Hereinafter, means of the invention and operational effects thereof will be described.

According to an aspect of the invention, there is provided a liquid ejecting apparatus including an apparatus main body that has a liquid ejecting head that can eject liquid onto a target object through nozzles, a movable body that is movable in a state where the liquid ejecting head is supported thereon, a movement guiding member that has a sliding surface and enables the movable body to move in a scanning direction perpendicular to a vertical direction in a state where the movable body is mounted thereon, a movement mechanism that causes the movable body to move, along the sliding surface, in the scanning direction, and a slide body that has an abutment portion which can abut on the movable body which moves in the scanning direction and has a cap member which can abut on the liquid ejecting head to surround the nozzles in such a manner that the slide body moves along with the movable body in a state where the abutment portion abuts on the movable body, in which the movable body has a connection portion in which the movable body is connected to the movement mechanism, and, in a state where the cap member abuts on the liquid ejecting head, the abutment portion of the slide body abuts on the movable body at a position which is located, in terms of a direction perpendicular to the sliding surface, at the same position as the connection portion or is located further on an anti-gravity direction than the connection portion.

In this case, a distance between a position in which the abutment portion of the slide body abuts on the movable body and the sliding surface is equal to or longer than a distance between a position in which a moving force which causes the movable body to move in the scanning direction is applied to the movable body and the sliding surface. Thus, a turning force which is generated by the reaction force of the abutment portion, which acts on the movable body in a state where the cap member abuts on the liquid ejecting head from a gravity direction side, and the moving force which is applied to the movable body causes the movable body to be pressed against the sliding surface without causing the movable body to be separated from the sliding surface. As a result, when movable body moves the slide body in the scanning direction, it is possible to stably move the movable body in a state where the movable body is not separated from the sliding surface.

It is preferable that the liquid ejecting apparatus further include a position adjusting mechanism which adjusts a position of the movable body so as to adjust a distance between the target object and the liquid ejecting head, and that, in a state where the connection portion is located farthest apart from the sliding surface of the movement guiding member, resulting from a positional adjustment of the movable body by the position adjusting mechanism, when the cap member abuts on the liquid ejecting head, the abutment portion of the slide body abut on the movable body at a position which is located, in terms of a direction perpendicular to the sliding surface, at the same position as the connection portion or is located further on the anti-gravity direction side than the connection portion.

In this case, a distance between a position in which the abutment portion of the slide body abuts on the movable body in a state where a position of the liquid ejecting head is adjusted in accordance with, for example, a thickness of a paper sheet as an example of a target object and the sliding surface is equal to or longer than a distance between the connection portion in a state where the cap member abuts on the liquid ejecting head and the sliding surface. Accordingly, it is possible to generate a turning force which causes the movable body to be pressed against the sliding surface without causing the movable body to be separated from the sliding surface.

In the liquid ejecting apparatus described above, it is preferable that, while the slide body moves in the scanning direction in a state where the abutment portion of the slide body abuts on the movable body, an abutment position in which the abutment portion abuts on the movable body move, in terms of a direction perpendicular to the sliding surface, from a position which is located further on a gravity direction side than the connection portion to a position which is located at the same position as the connection portion or is located further on the anti-gravity direction side than the connection portion.

In this case, for example, when the abutment portion of the slide body abuts on the movable body, the cap member does not abut on the liquid ejecting head. Thus, a reaction force generated in the abutment portion of the slide body which moves along with the movable body in a state where the abutment portion abuts on the movable body is small. Accordingly, in a case where the abutment position of the abutment portion is located further on the gravity direction side than the connection portion, a force acting in a direction in which the movable body is separated from the sliding surface is small. As a result, a force which causes the movable body to be separated from the sliding surface is small, and thus the movable body can move in a state where the movable body is not separated from the sliding surface, due to the weight of the movable body. In addition, a pressing force of the movable body against the sliding surface is reduced, and thus it is possible to smoothly move the movable body by suppressing a frictional resistance between the movable body and the sliding surface. Furthermore, when the movable body moves until the cap member abuts on the liquid ejecting head, the abutment portion moves upward. Thus, in a state where the cap member abuts on the liquid ejecting head, a turning force which causes the movable body to be pressed against the sliding surface is generated. As a result, when the movable body moves the slide body in the scanning direction, it is possible to stably move the movable body in a state where the movable body is not separated from the sliding surface.

In the liquid ejecting apparatus, it is preferable that the slide body have a plurality of the abutment portions which are aligned in a direction which is parallel to the sliding surface and perpendicular to the scanning direction, and that, in a state where the cap member abuts on the liquid ejecting head, at least one of the plurality of the abutment portions abut on the movable body at a position which is located, in terms of a direction perpendicular to the sliding surface, at the same position as the connection portion or is located further on the anti-gravity direction side than the connection portion.

In this case, a plurality of the abutment portions are provided, and thus it is possible to move the slide body in the scanning direction, using the movable body, while suppressing rotation of the movable body about an axis perpendicular to the sliding surface. In addition, it is possible to generate a turning force which causes the movable body to be pressed against the sliding surface, by at least one of the abutment portions.

In the liquid ejecting apparatus, it is preferable that the slide body be configured such that a portion having the cap member and a portion having the abutment portion are formed to be separate.

In this case, it is possible to adjust a distance, in terms of the vertical direction, between the abutment portion and the sliding surface in a state where the cap member abuts on the liquid ejecting head. Thus, it is possible to easily control the turning force acting on the movable body to cause the movable body to be pressed against the sliding surface.

It is preferable that the liquid ejecting apparatus further include a liquid supplying tube which guides the liquid, which is fed from a liquid receiving body in which the liquid is received, to the liquid ejecting head and has a deformable portion which can be deformed in accordance with movement of the movable body, and that at least a part of the liquid receiving body be provided outside the apparatus main body.

In this case, it is possible to obtain the liquid ejecting apparatus in which the movable body can stably move in a state where the movable body is not separated from the sliding surface and a large amount of ink can be fed to the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet type printer (hereinafter, also referred to simply as a "printer") as an example of a liquid ejecting apparatus will be described with reference to the accompanying drawings. The printer of this embodiment performs printing on a paper sheet P in such a manner that the printer forms an image or the like by ejecting ink as an example of liquid onto the paper sheet P as an example of a target object.

Figure 1:
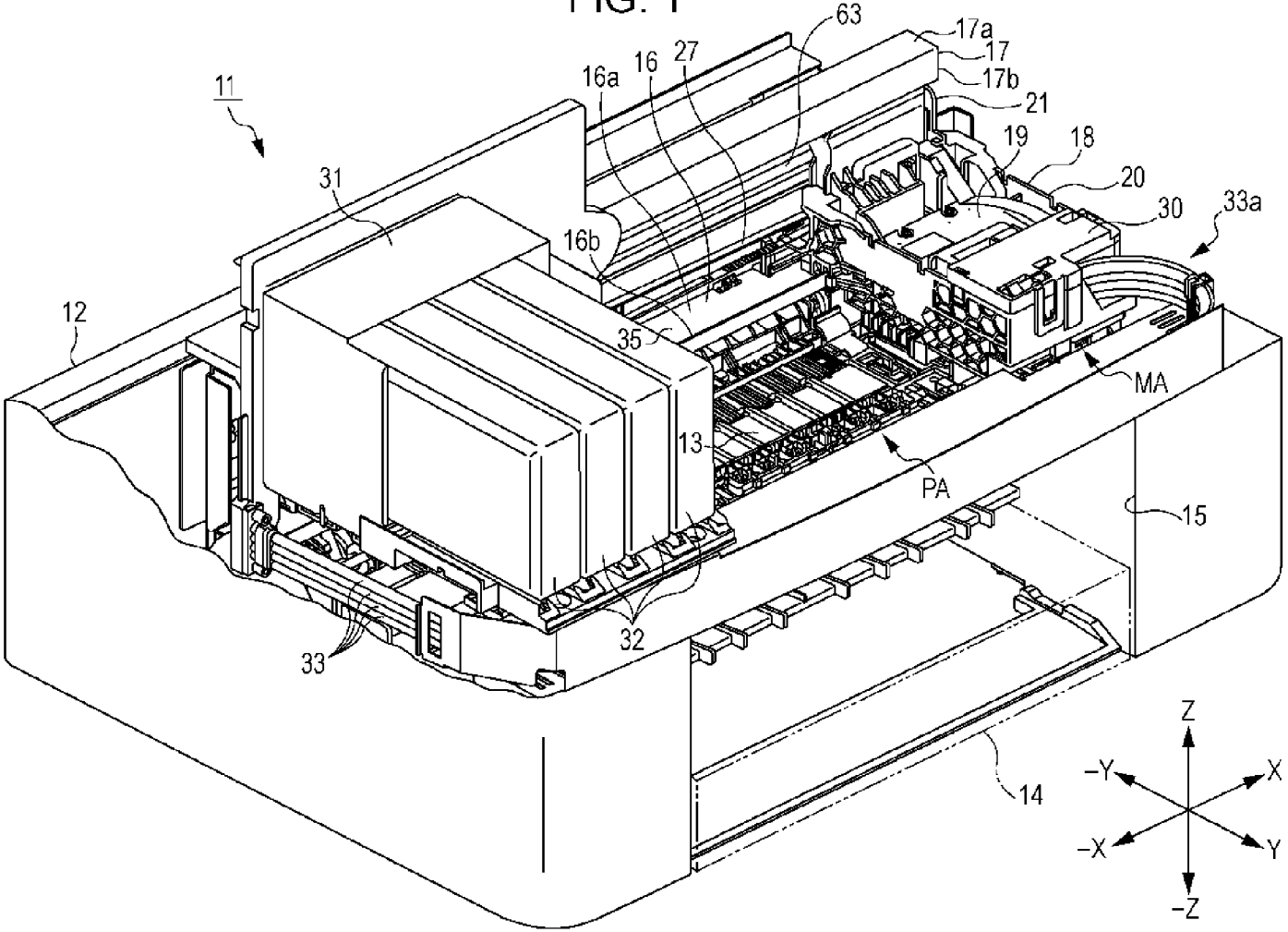
FIG. 1 is a perspective view illustrating an ink jet type printer according to an embodiment.
Figure 2:
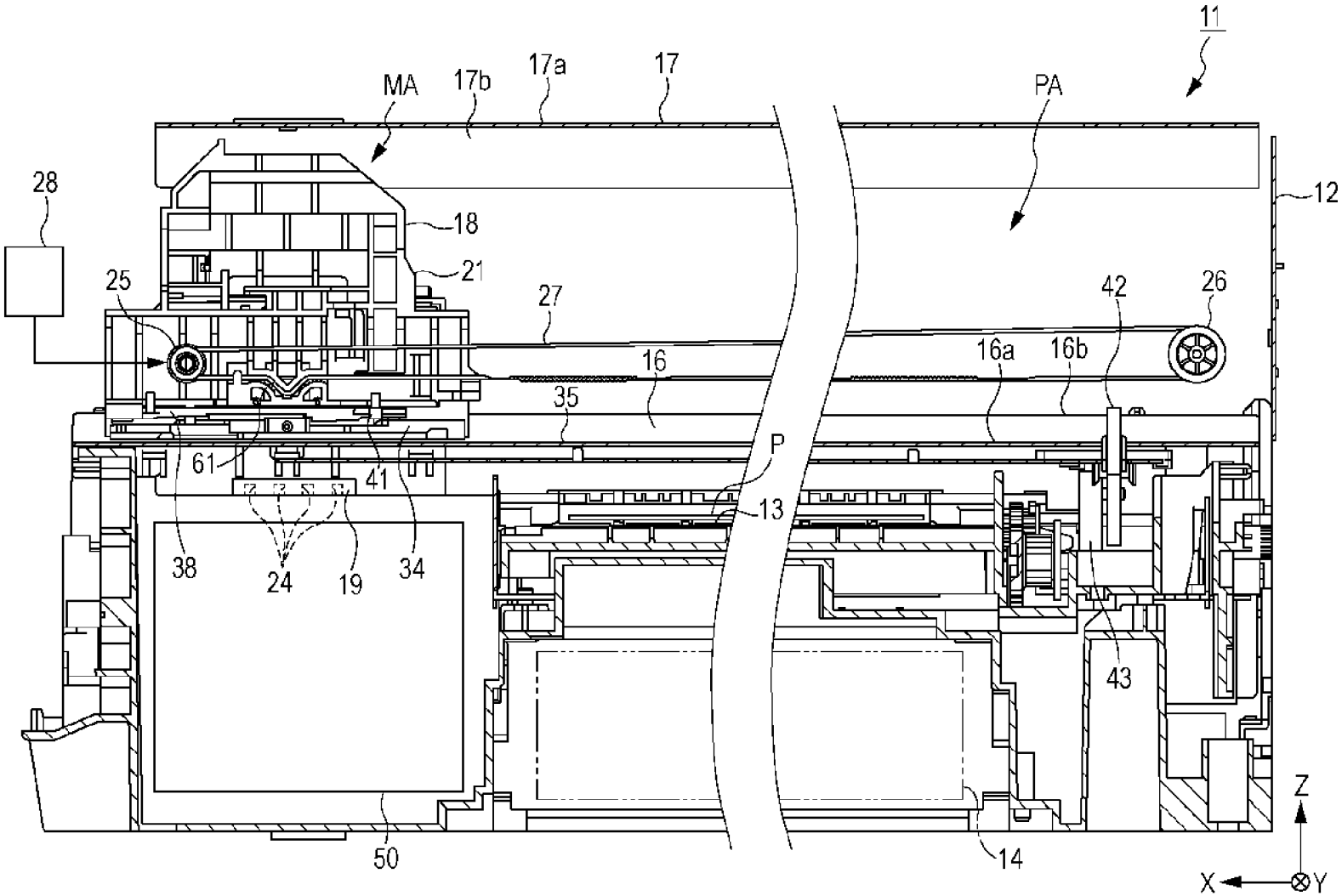
FIG. 2 is a schematic cross-sectional view illustrating a rear side of the printer.

A printer 11 has a main body frame 12 as an apparatus main body of the printer 11 which has a substantially rectangular box shape, as illustrated in FIGS. 1 and 2. A support base 13 which supports the paper sheets P when printing is performed is provided in the main body frame 12 so as to extend in a longitudinal direction of the main body frame 12. A paper sheet cassette 14 in which the paper sheets P are received in a stacked state is detachably mounted to a lower side of the support base 13, which is a gravity direction side, through an opening portion 15 formed in a middle portion of the main body frame 12. The paper sheets P in the paper sheet cassette 14 are fed, one by one, over the support base 13, through a paper feeding mechanism having a paper feeding roller and a transporting roller (not illustrated), in which a direction from a rear side (a back side) of the printer 11, which is a side opposite the opening portion 15 side, to the opening portion 15 side (a front side) is set to a transporting direction Y. In other words, the uppermost paper sheet P of the stacked paper sheets P in the paper sheet cassette 14 is fed over the support base 13 in such a manner that the uppermost paper sheet P is sent from the paper sheet cassette 14 by driving the paper feeding roller, and then is transported by the transporting roller. In the following description, an anti-gravity direction of a vertical direction is set to a Z direction and a gravity direction is set to a −Z direction. A direction opposite the transporting direction Y is set to a −Y direction.

A main guiding member 16, as an example of a movement guiding member, which extends in a longitudinal direction of the main body frame 12 is installed in an upper side (the Z direction side) of the support base 13 in the main body frame 12. The main guiding member 16 has a main guiding portion 16*a* and an auxiliary guiding portion 16*b*. The main guiding portion 16*a* is a strip-shaped flat surface of which an upper surface facing the Z direction extends substantially parallel to a horizontal plane. The auxiliary guiding portion 16*b* is formed by bending a front edge portion of the main guiding portion 16*a* upward at a right angle.

A sub-guiding member 17 which extends in the longitudinal direction is provided on an upper side of the main guiding member 16 in the main body frame 12. The sub-guiding member 17 includes a strip-shaped portion 17*a* and a sub-guiding portion 17*b*. The strip-shaped portion 17*a* extends in a substantially horizontal direction. The sub-guiding portion 17*b* is formed by being bent about the front-side (the Y direction side) half of the strip-shaped portion 17*a* downward (in the −Z direction) at a right angle. A carriage 18 as an example of a movable body is mounted on the main guiding portion 16*a* of the main guiding member 16. The carriage 18 is provided in a state where a rear end portion side, that is the −Y direction side, thereof is supported in a cantilever-support manner, by the main guiding member 16 and the sub-guiding member 17, such that the carriage 18 can reciprocate in a scanning direction, that is, the longitudinal direction. In the following description, a right direction of the scanning direction along which the carriage 18 moves is set to an X direction and a left direction thereof is set to a −X direction when viewed form a front side in the transporting direction Y.

Figure 3:
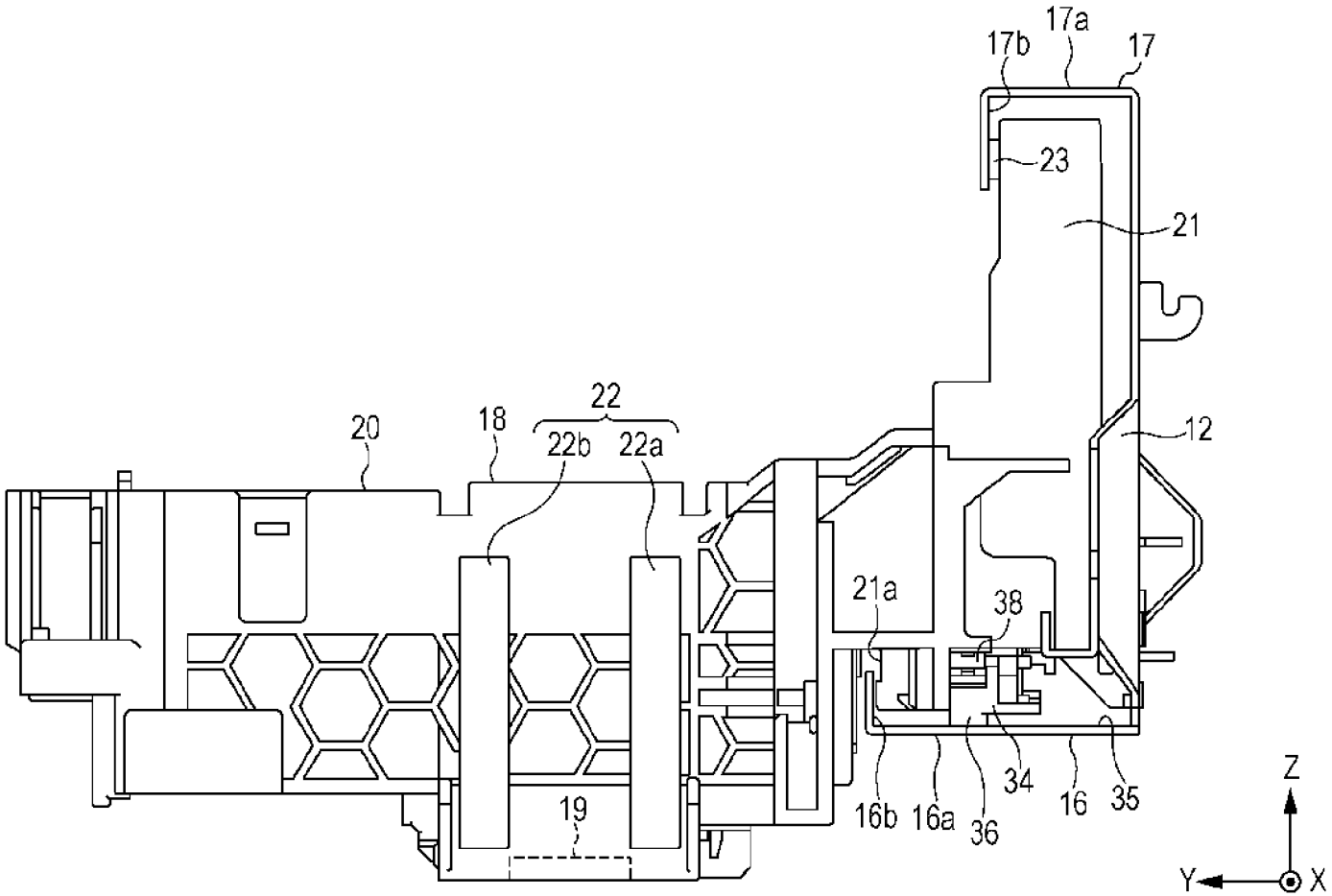
FIG. 3 is a schematic view illustrating a lateral side of a carriage in a state where a liquid ejecting head is supported on the carriage.

The carriage 18 includes a support portion 20 which has a substantially rectangular box shape and supports a liquid ejecting head 19 capable of ejecting ink as an example of liquid through a plurality of nozzles 24 formed therein and a supported portion 21 which is integrally formed on a rear side (the −Y direction side) of the support portion 20 and supported by the main guiding member 16 and the sub-guiding member 17, as illustrated in FIGS. 1 to 3.

A groove 21*a* into which the auxiliary guiding portion 16*b* is inserted is formed on a front end portion of a lower surface of the supported portion 21, which faces the −Z direction. Therefore, the auxiliary guiding portion 16*b* prevents the carriage 18 from moving in a front and rear direction, along the transporting direction Y, and allows the carriage 18 to move in a right and left direction and in an up and down direction.

Meanwhile, an auxiliary sliding contact portion 23 which is in slide contact with a rear surface of the sub-guiding portion 17*b* by weight of the carriage 18 is formed on a front surface of an upper end portion of the supported portion 21. Thus, the sub-guiding portion 17*b* prevents the carriage 18 from moving to a front side (in the transporting direction Y) and allows the carriage 18 to move in the right and left direction (in a scanning direction) and in the up and down direction (in the vertical direction). Therefore, the carriage 18 can reciprocate in the right and left direction, which is the scanning direction, in a state where the carriage 18 is guided by the main guiding member 16 and the sub-guiding member 17.

The carriage 18 is connected, in a fixed manner, with part of an endless driving belt 27 as a movement mechanism which is wound around a driving pulley 25 and a driven pulley 26 which are provided on right and left end portions of an inner surface of a rear wall of the main body frame 12. An output shaft of a carriage motor 28 which is provided in the main body frame 12 is connected to the driving pulley 25. Accordingly, the carriage 18 is connected with the driving belt 27 which is driven by the carriage motor 28 to circle the pulleys, and thus reciprocates in the scanning direction, along the main guiding member 16 and the sub-guiding member 17.

A driving force from the carriage motor 28 is applied to a connection portion 61 of the carriage 18, to which the driving belt 27 is connected, as a force for moving the carriage 18 in the scanning direction, as described above. Therefore, the connection portion 61 functions as a moving force receiving portion. This connection portion 61 which functions as the moving force receiving portion is positioned further on an upper side, that is, the Z direction side, in a direction perpendicular to a flat surface which is formed on a Z-direction side upper surface of the main guiding portion 16*a* of the main guiding member 16 than the flat surface.

A portion to be abutted 22 on which an abutment portion 55 (see FIG. 9) of a slide body 52 described below abuts is provided on a right side surface of the X direction side of the support portion 20 of the carriage 18, as illustrated in FIG. 3. In other words, in this embodiment, two flat surface portions which have strip shapes extending in the vertical direction and are arranged at a predetermined interval in the transporting direction Y perpendicular to the scanning direction are provided as a first portion to be abutted 22*a* and a second portion to be abutted 22*b* which constitute the portion to be abutted 22.

A plurality of (four, in this embodiment) valve units 30 which supply temporary stored ink to the liquid ejecting head 19 are provided on an upper side, that is, the Z direction side, of the support portion 20, as illustrated in FIG. 1. In addition, a lower end portion of the liquid ejecting head 19 in a supported state is exposed through a lower surface side of the –Z direction side of the support portion 20, which faces the support base 13, as illustrated in FIG. 2.

A plurality of nozzles 24 which constitute a plurality of (four, in this embodiment) nozzle arrays are opened on a lower surface of the liquid ejecting head 19, of which the lower end portion is exposed. Printing is performed in such a manner that ink is ejected onto the paper sheet P which is fed on the support base 13, through an opening of the nozzles 24 which constitutes the nozzle arrays. An area in which printing can be performed, by the liquid ejecting head 19, on the paper sheet P having the maximum width, which is disposed on the support base 13 is set to a printing area PA.

A cartridge holder 31 is provided on a left end portion in the main body frame 12. A plurality of (four, in this embodiment) ink cartridges 32, in each of which ink of different color is stored, are detachably mounted to the cartridge holder 31. The cartridge holder 31 is connected to the respective valve units 30 on the carriage 18, through ink supplying tubes 33 as an example of a liquid supplying tube. In a state where each ink cartridges 32 is mounted to the cartridge holder 31, each ink cartridges 32 communicates with each valve unit 30, through each ink supplying tube 33. Each ink supplying tube 33 has a curved portion 33*a* as a deformation movable portion which is deformed in accordance with movement of the carriage 18. The ink supplying tubes 33 are respectively communicate with the valve units 30.

Figure 4:
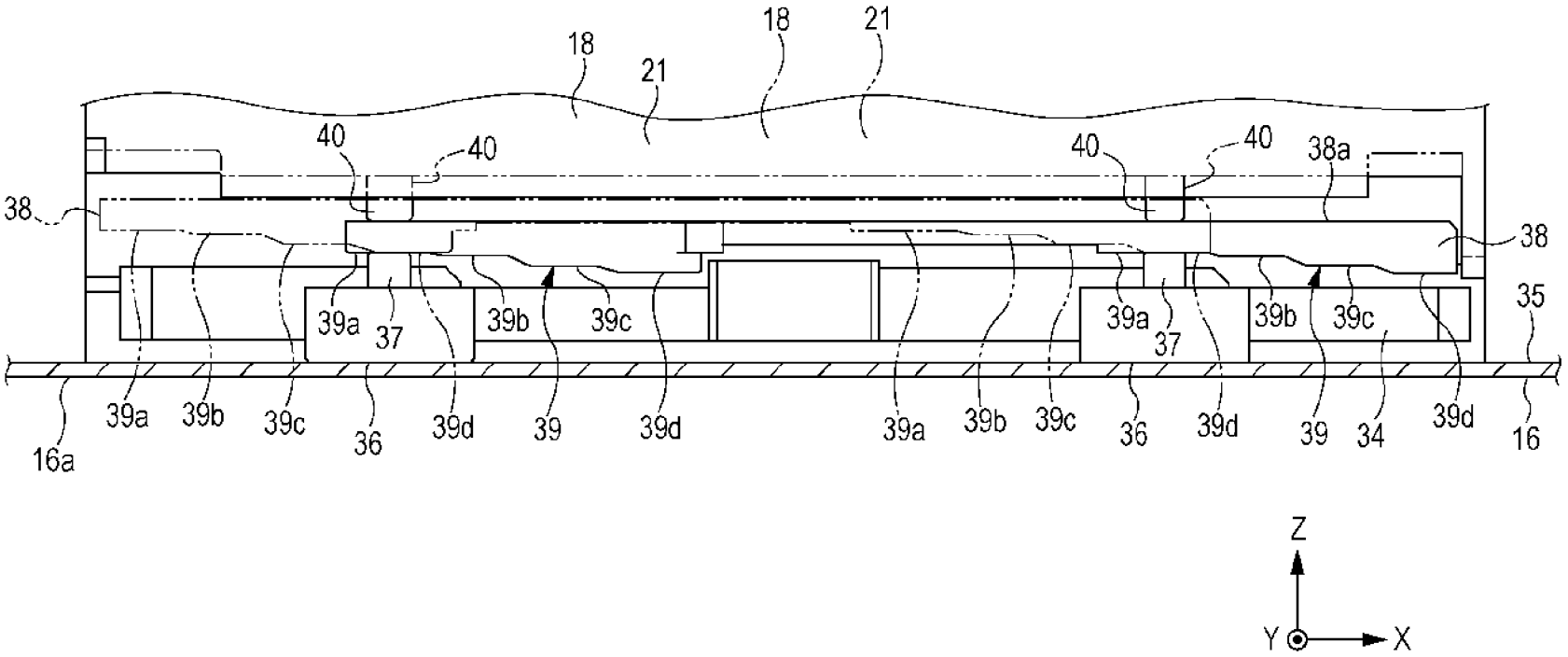
FIG. 4 is an enlarged schematic view illustrating principal portions of a position adjusting mechanism which is provided on the carriage.

The supported portion 21 of the carriage 18 is supported to be slidable on the main guiding portion 16*a*, through a sliding member 34 which extends in the right and left direction, in a state where the supported portion 21 is mounted on the main guiding portion 16*a* of the main guiding member 16, as illustrated in FIGS. 3 and 4. In other words, a pair of right and left sliding contact portions 36 which protrude downward and are in slide contact with the flat surface are provided on the sliding member 34 to be aligned in the right and left direction at an interval. Thus, the flat surface of the main guiding portion 16*a* forms a sliding surface 35 on which the sliding contact portions 36 of the sliding member 34 slide. The pair of right and left sliding contact portions 36 move on the sliding surface 35, for example, in a state where the sliding contact portions 36 are pressed against the sliding surface 35 by the weight of the carriage 18. Accordingly, the carriage 18 (the supported portion 21) moves along the sliding surface 35 in a state where the sliding contact portions 36 thereof are not separated from, that is, do not incline relative to, the sliding surface 35.

The printer 11 of this embodiment detects a position or a movement distance of the carriage 18 in the scanning direction in such a manner that an encoder (not illustrated) which is installed in the carriage 18 reads a linear scale 63 extending in the scanning direction and generates an encoded electrical signal, as illustrated in FIG. 1. Thus, when the carriage 18 moves, in a parallel direction, along the sliding surface 35 of the main guiding portion 16*a* in a state where a posture of the carriage 18 is not inclined, the encoder can accurately read the linear scale 63. As a result, it is possible to accurately detect the position or the movement distance of the carriage 18 in the scanning direction.

In addition, a position adjusting mechanism by which a distance between the liquid ejecting head 19 and the support base 13, that is, a distance between the liquid ejecting head 19 and the paper sheet P on the support base 13, is adjusted in such a manner that a vertical position of the carriage 18 is adjusted is provided in the printer 11 of this embodiment, as illustrated in FIGS. 2 to 4.

In other words, each convex portion 37 which protrudes upward is formed on an upper surface of each sliding contact portion 36. A cam member 38 as a position adjusting member is mounted on the convex portions 37 so as to be suspended across the convex portions 37. An upper surface 38*a* of the cam member 38 is a horizontal surface but a lower surface of the cam member 38 is a cam surface which forms a pair of right and left cam portions 39. Each convex portion 37 is in slide contact with each cam portion 39 which is formed along the cam surface.

Four horizontal surfaces, that is, a first cam surface 39*a*, a second cam surface 39*b*, a third cam surface 39*c*, and a fourth cam surface 39*d*, are aligned on the lower surface (the cam surface) of each cam portion cam portion 39 such that heights relative to the sliding surface 35 are lowered in stages as the cam surface moves closer, from a left side, to a right side. A portion between adjacent cam surfaces, that is, a portion between the first cam surface 39*a* and the second cam surface 39*b*, a portion between the second cam surface 39*b* and the third cam surface 39*c*, or a portion between the third cam surface 39*c* and the fourth cam surface 39*d*, is connected through a gentle inclined surface.

A pair of right and left leg portions 40 which protrude from the lower surface of the supported portion 21 of the carriage 18 respectively abut on parts of the upper surface 38*a* of the cam member 38, which are portions opposite the convex portion 37 with interposing the cam member 38 therebetween. The cam member 38 is movable, with respect to the convex portions 37 and the leg portions 40 in a sliding manner, in the right and left direction. The cam member 38 can adjust the vertical position of the carriage 18 in such a manner that the cam member 38 moves, in a sliding manner, in the right and left direction such that a position (the cam surface) on each cam portion 39, on which each convex portion 37 abuts, is changed.

An engaging pin 41 is provided on a left end portion of a rear surface of the cam member 38 to protrude rearward, as illustrated in FIG. 2. Meanwhile, a cam moving plate 42 is provided on a rear side of the main guiding member 16 and in a left end portion in the main body frame 12. When the carriage 18 moves in the right and left direction, the cam moving plate 42 can be engaged with the engaging pin 41 from the right side or the left side. The cam moving plate 42 pivots, by a pivoting mechanism 43, between an engaged position in which, when the carriage 18 moves in the right and left direction, the cam moving plate 42 is engaged with the engaging pin 41 and a non-engaged position in which the cam moving plate 42 is not engaged with the engaging pin 41.

In a state where the cam moving plate 42 pivots to the engaged position, the carriage 18 moves in a left direction (the −X direction) to engage the engaging pin 41 with the cam moving plate 42 from a right side, and thus, when the carriage 18 moves further in the left direction, the cam member 38 moves, in a sliding manner, in a right direction (the X direction). In contrast, in a state where the cam moving plate 42 pivots to the engaged position, the carriage 18 moves in the right direction (the X direction) to engage the engaging pin 41 with the cam moving plate 42 from the left side, and thus, when the carriage 18 moves further in the right direction, the cam member 38 moves, in a sliding manner, in the left direction (the −X direction).

As a result, in a case where the cam member 38 moves in a sliding manner, and thus the respective convex portions 37 of the sliding member 34 abut on the respective first cam surfaces 39*a* of the cam member 38, the carriage 18 is located in the lowest position, as illustrated by the solid line in FIG. 4. In contrast, in a case where the respective convex portions 37 of the sliding member 34 abut on the respective fourth cam surfaces 39*d* of the cam member 38, the carriage 18 is located in the highest position, as illustrated by the two-dot chain line in FIG. 4.

As described above, the vertical position of the carriage 18 is adjusted in such a manner that the carriage 18 moves in the up and down direction following the movement of the cam member 38 in the up and down direction due to the movement of the cam member 38 in the right and left direction. Furthermore, the liquid ejecting head 19 is supported by the carriage 18, and thus the distance between the liquid ejecting head 19 and the support base 13, that is, the distance between the liquid ejecting head 19 and the paper sheet P on the support base 13, is adjusted in such a manner that a vertical position of the carriage 18 is adjusted. As described above, the position adjusting mechanism by which the distance between the liquid ejecting head 19 and the paper sheet P on the support base 13 is adjusted is provided in the printer 11.

Furthermore, in this embodiment, a width of the paper sheet P on the support base 13 is detected using a paper width detecting sensor (not illustrated) which is provided on the carriage 18. In other words, the paper width detecting sensor is a so-called reflection type sensor in which reflected light is detected. When the paper width detecting sensor scans over the support base 13 in accordance with the movement of the carriage 18 in the right and left direction (the scanning direction), the paper width detecting sensor measures an amount (intensity of illumination, an amount of light, or the like) of the reflected light from the support base 13. Then, the paper width detecting sensor detects the width of the fed paper sheet P, using the measured amount of the reflected light. In the printer 11, the liquid ejecting head 19 moves in the right and left direction, in accordance with the detected width of paper, and the liquid ejecting head 19 appropriately ejects ink onto the paper sheet P.

In some cases, when the paper sheet P is fed on the support base 13 in the printer 11, static electricity is caused due to rubbing of the paper sheet P against the support base 13. In such a case, for example, paper dust from the paper sheet P is scattered by the generated static electricity and the scattered paper dust adheres to the liquid ejecting head 19. Therefore, this obstructs the ink from being ejected appropriately. As a result, there is possibility that printing may not be performed reliably. A method for suppressing scattering of paper dust, in which the support base 13 is configured to have conductivity, and thus the generated static electricity quickly flows from the support base 13 to the main body frame 12 or the like, is applied to the printer 11 as described below.

As an example of the method for imparting conductivity to the support base 13, it is possible to conceive that the support base 13 is formed from a metallic material having conductivity. However, light is easily reflected by a metallic material. For this reason, when the paper width detecting sensor of a reflection type sensor detects the width of the paper sheet P, there is possibility that the width of the paper is incorrectly detected due to a small difference between the amount of the reflected light from the support base 13 and the amount of the reflected light from the paper sheet P. To prevent such an incorrect detection, it is possible to conceive that a surface (a metallic surface) of the support base 13, which corresponds to a sensor movement area within which the paper width detecting sensor scans, is coated with some material. However, in this case, there is possibility that the coated material may be peeled off because the coated surface is rubbed by the fed paper sheet P.

Figure 5:
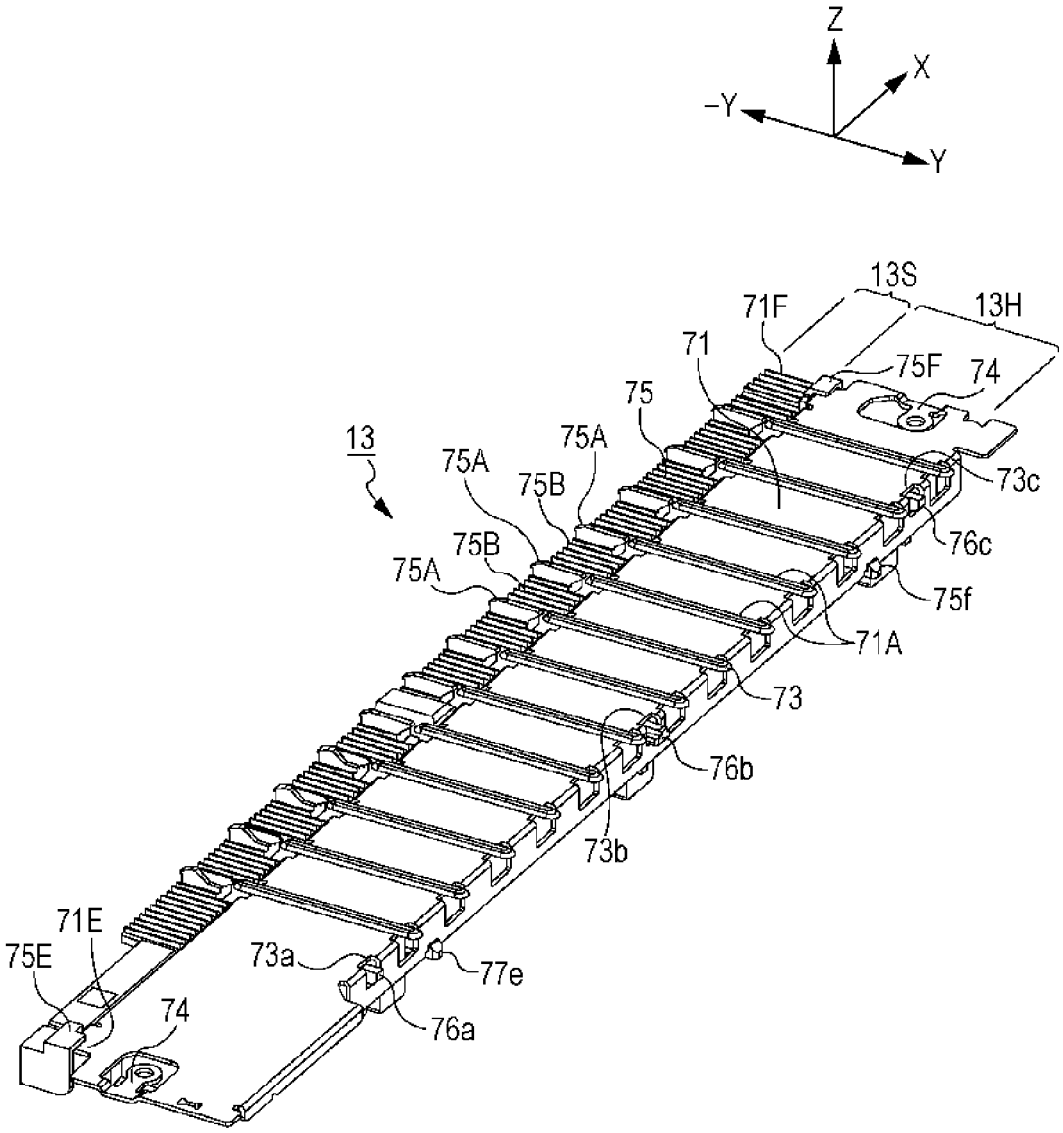
FIG. 5 is a perspective view illustrating a support base which is provided on the printer to support paper sheets when printing is performed.

In the support base 13 of this embodiment, a resin material having conductivity is used as a material forming a sensor moving area 13S over which the paper width detecting sensor installed in the carriage 18 scans and a metallic material having conductivity is used as a material forming a head moving area 13H over which the liquid ejecting head 19 scans, as illustrated in FIG. 5. Specifically, the support base 13 includes a main support base 71 and a sub-support base 75. An upper surface of the main support base 71, which faces the carriage 18, has a substantially rectangular shape of which a longitudinal direction is parallel to the scanning direction (the X direction). In the upper surface of the main support base 71, a rectangular area on a downstream side (the Y direction side) in the transporting direction is a surface formed of a metallic material. In an upper surface of the sub-support base 75, a rectangular area on an upstream side (the −Y direction side) in the transporting direction is a surface formed of a resin material. The main support base 71 and the sub-support base 75 are assembled together. Assembling of the main support base 71 and the sub-support base 75 will be described below.

The main support base 71 is a rectangular plate formed of aluminum which is metallic material having conductivity. A plurality of projecting portions 71A which protrude upward at substantially constant intervals in the scanning direction which is parallel to the longitudinal direction of the main support base 71 are formed, by press working, on the main support base 71. A striation direction of the projecting portions 71A is substantially parallel to the transporting direction Y. Furthermore, the main support base 71 has an upstream side wall plate 72 (see FIG. 6) and a downstream side wall plate 73. The upstream side wall plate 72 is provided on an upstream side of the main support base 71 in the transporting direction Y and the downstream side wall plate 73 is provided on a downstream side of the main support base 71 in the transporting direction Y. The upstream side wall plate 72 and the downstream side wall plate 73 are formed by bending an aluminum-based rectangular plate in the gravity direction at an approximately right angle. Accordingly, the main support base 71 is formed in a substantially C shape when viewed from the scanning direction (see FIGS. 8A and 8B). Furthermore, fixing portions 74 are provided on both end portions of the main support base 71 in the scanning direction, that is, the longitudinal direction of the main support base 71. The fixing portions 74 are fixed to the main body frame 12 using screws (not illustrated) as an example of a fastening member.

The sub-support base 75 is formed by injection molding using a resin material, as a resin material having conductivity, obtained by mixing a resin material containing a high molecular polymer, a conductivity material such as carbon, and the like. Alternatively, the sub-support base 75 is formed by the following procedure. First, injecting molding is performed with a thermoplastic resin material, and then a metallic material is applied, by electroplating, electroless plating or the like, onto a surface of a component obtained through injecting molding. A plurality of plate-shaped ribs 75A are formed, by injection molding or the like, on the sub-support base 75 to protrude upward, in which a longitudinal direction of the plate-shaped rib 75A is parallel to the transporting direction Y. The plurality of plate-shaped ribs 75A are provided in the sensor moving area 13S over which the paper width detecting sensor scans such that the plurality of plate-shaped ribs 75A corresponds to the plurality of projecting portions 71A formed in the main support base 71, one by one, in the scanning direction. In other words, each plate-shaped rib 75A of the sub-support base 75 and each projecting portion 71A of the main support base 71 are disposed to be superimposed on each other when viewed from the transporting direction Y. Furthermore, in the sensor moving area 13S of the sub-support base 75, an upper surface area between adjacent plate-shaped ribs 75A forms a concave/convex surface area 75B on which a plurality of concave and convex shapes are formed. In this embodiment, the concave and convex shapes are formed such that concave portions and convex portions are regularly repeated along the scanning direction at fine pitches. The concave and convex shapes may be irregular concave and convex shapes formed by, for example, an embossed portion on a molding die.

Figure 6:
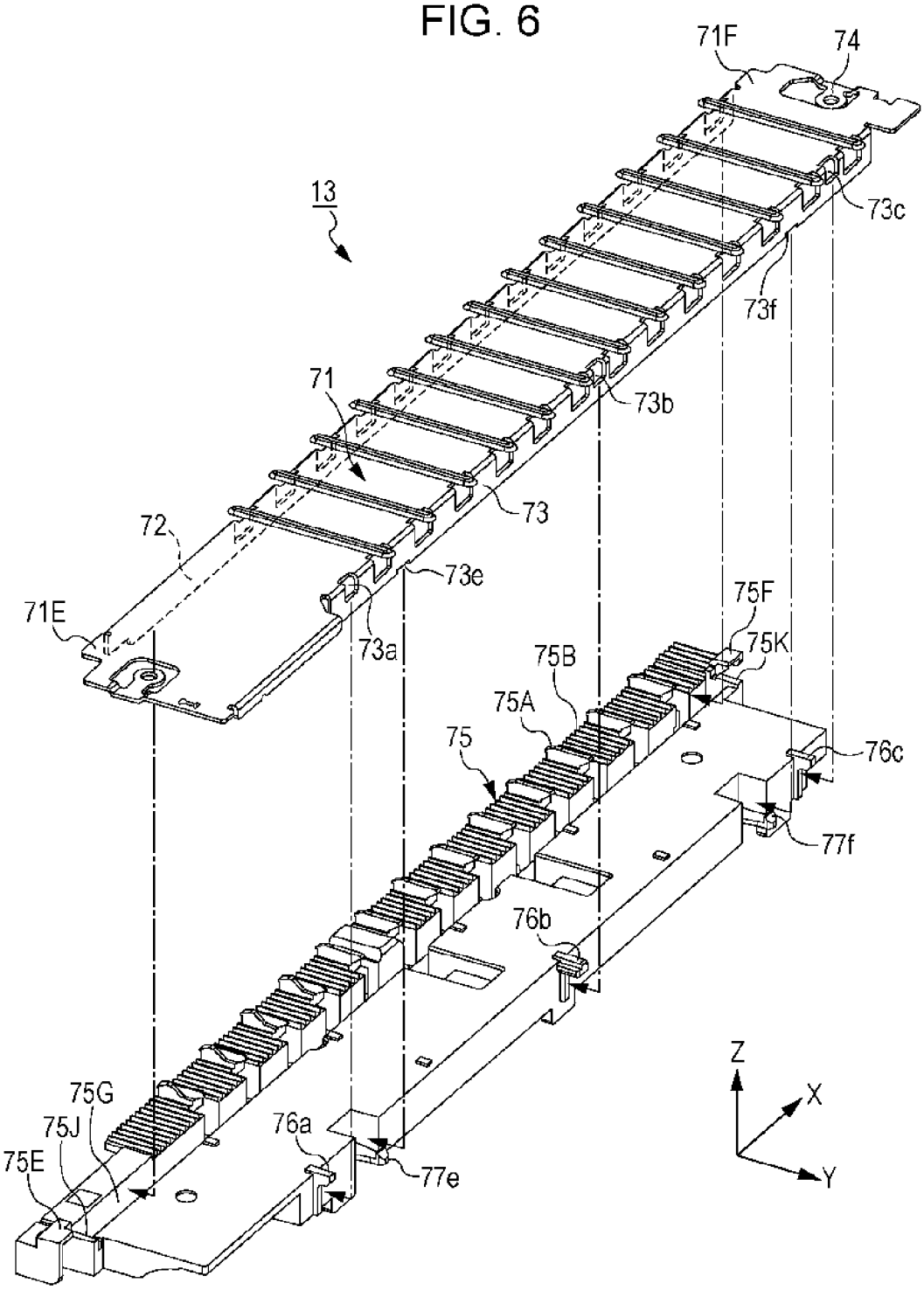
FIG. 6 is an exploded perspective view illustrating a configuration of components of the support base of the paper sheets.

The main support base 71 and the sub-support base 75 are assembled together, as illustrated in FIG. 6. In other words, in the sub-support base 75, a first protrusion portion 76*a*, a second protrusion portion 76*b*, and a third protrusion portion 76*c* which protrude in the transporting direction Y are provided on an upper end portion on the downstream side in the transporting direction, at predetermined intervals in the scanning direction. Furthermore, a first hook portion 77*e* and a second hook portion 77*f* which protrude in the transporting direction Y and are elastically deformable downward are provided on a lower end portion on a downstream side in the transporting direction, at predetermined intervals in the scanning direction. The second protrusion portion 76*b* is disposed in a substantially middle portion of the sub-support base 75 in the longitudinal direction (the scanning direction). The first protrusion portion 76*a* on the −X direction side and the third protrusion portion 76*c* on the X direction side are arranged substantially symmetrically, in terms of scanning direction, with respect to the second protrusion portion 76*b* as a center. Also, the first hook portion 77*e* and the second hook portion 77*f* are arranged substantially symmetrically, in terms of the scanning direction, with respect to the second protrusion portion 76*b* as a center.

In the sub-support base 75, a groove portion 75G is formed adjacent to a downstream side of the sensor moving area 13S, over which the paper width detecting sensor scans, in the transporting direction. A longitudinal direction of the groove portion 75G is parallel to the scanning direction. The groove portion 75G has a predetermined width in the transporting direction and allows the upstream side wall plate 72 of the main support base 71 to be inserted thereinto. A first eave portion 75E and a second eave portion 75F which protrude, in the transporting direction Y, from an upper portion of the sub-support base 75 to form a flange shape are provided on both end portions of the groove portion 75G in the scanning direction.

Meanwhile, a first hole portion 73*a*, a second hole portion 73*b*, and a third hole portion 73*c* are aligned, in the scanning direction, on the downstream side wall plate 73 of the main support base 71. The first hole portion 73*a*, the second hole portion 73*b*, and the third hole portion 73*c* are arranged to correspond to the first protrusion portion 76*a*, the second protrusion portion 76*b*, and the third protrusion portion 76*c* which are provided on the sub-support base 75 one by one. Furthermore, on the main support base 71, a first notch portion 73*e* and a second notch portion 73*f* are aligned in the scanning direction so as to correspond, one by one, to the first hook portion 77*e* and the second hook portion 77*f* which are provided on the sub-support base 75. Furthermore, in upstream side of the main support base 71 in the transporting direction, a first corner portion 71E and a second corner portion 71F are provided on both end portions in the scanning direction such that the first corner portion 71E and the second corner portion 71F correspond to the first eave portion 75E and the second eave portion 75F which are provided on the sub-support base 75 one by one.

Therefore, when the main support base 71 moves, relative to the sub-support base 75, from upward to downward, the upstream side wall plate 72 is inserted into the groove portion 75G and the downstream side wall plate 73 is disposed on the downstream side in the transporting direction, relative to the first protrusion portion 76*a*, the second protrusion portion 76*b*, and the third protrusion portion 76*c*, as illustrated by the one-dot chain line arrows in FIG. 6. Next, when the main support base 71 moves, relative to the sub-support base 75, to the upstream side in the transporting direction by a predetermined distance, the first protrusion portion 76*a*, the second protrusion portion 76*b*, and the third protrusion portion 76*c* of the sub-support base 75 are inserted into the first hole portion 73*a*, the second hole portion 73*b*, and the third hole portion 73*c* one by one. In addition, the first corner portion 71E and the second corner portion 71F of the main support base 71 are inserted into lower sides of the first eave portion 75E and the second eave portion 75F of the sub-support base 75 one by one. Further, the first hook portion 77*e* and the second hook portion 77*f* of the sub-support base 75 are engaged with the first notch portion 73*e* and the second notch portion 73*f* of the downstream side wall plate 73 of the main support base 71 one by one.

In this embodiment, as illustrated in FIG. 5, the main support base 71 and the sub-support base 75 are assembled together in such a manner that the main support base 71 moves relatively to the sub-support base 75 as described above. In a state where the main support base 71 and the sub-support base 75 are assembled together, the second protrusion portion 76*b* of the sub-support base 75 is inserted into the second hole portion 73*b* almost without having a gap in the scanning direction. In contrast, the first protrusion portion 76*a* and the third protrusion portion 76*c* are respectively inserted into the first hole portion 73*a* and the third hole portion 73*c*, with a gap in the scanning direction. Furthermore, the main support base 71 is inserted into the first eave portion 75E and the second eave portion 75F of the sub-support base 75, almost without having a gap in the upstream side of the transporting direction and with a gap in the scanning direction. Furthermore, movement of the main support base 71 to the downstream side in the transporting direction, relative to the sub-support base 75, is regulated by the first hook portion 77*e* and the second hook portion 77*f* of the sub-support base 75 which are engaged with the first notch portion 73*e* and the second notch portion 73*f* of the downstream side wall plate 73 of the main support base 71.

Movement of the main support base 71 in the up and down direction is regulated, relative to the sub-support base 75. In other words, in the upstream side of the transporting direction, the movement of an upper side of the main support base 71 is prevented by the first eave portion 75E and the second eave portion 75F of the sub-support base 75. In addition, the movement of a lower side of the main support base 71 is prevented by a first rib-shaped portion 75J and a second rib-shaped portion 75K which is provided in the vicinity of the first eave portion 75E and the second eave portion 75F of the sub-support base 75. Meanwhile, in the downstream side of the transporting direction, movement of an upper side of the main support base 71 is prevented by the second protrusion portion 76*b* of the sub-support base 75 and movement of a lower side of the main support base 71 is prevented by the first hook portion 77*e* and the second hook portion 77*f* of the sub-support base 75.

Next, an operation of the support base 13 will be described with reference to FIGS. 7 to 8B.

Figure 7:
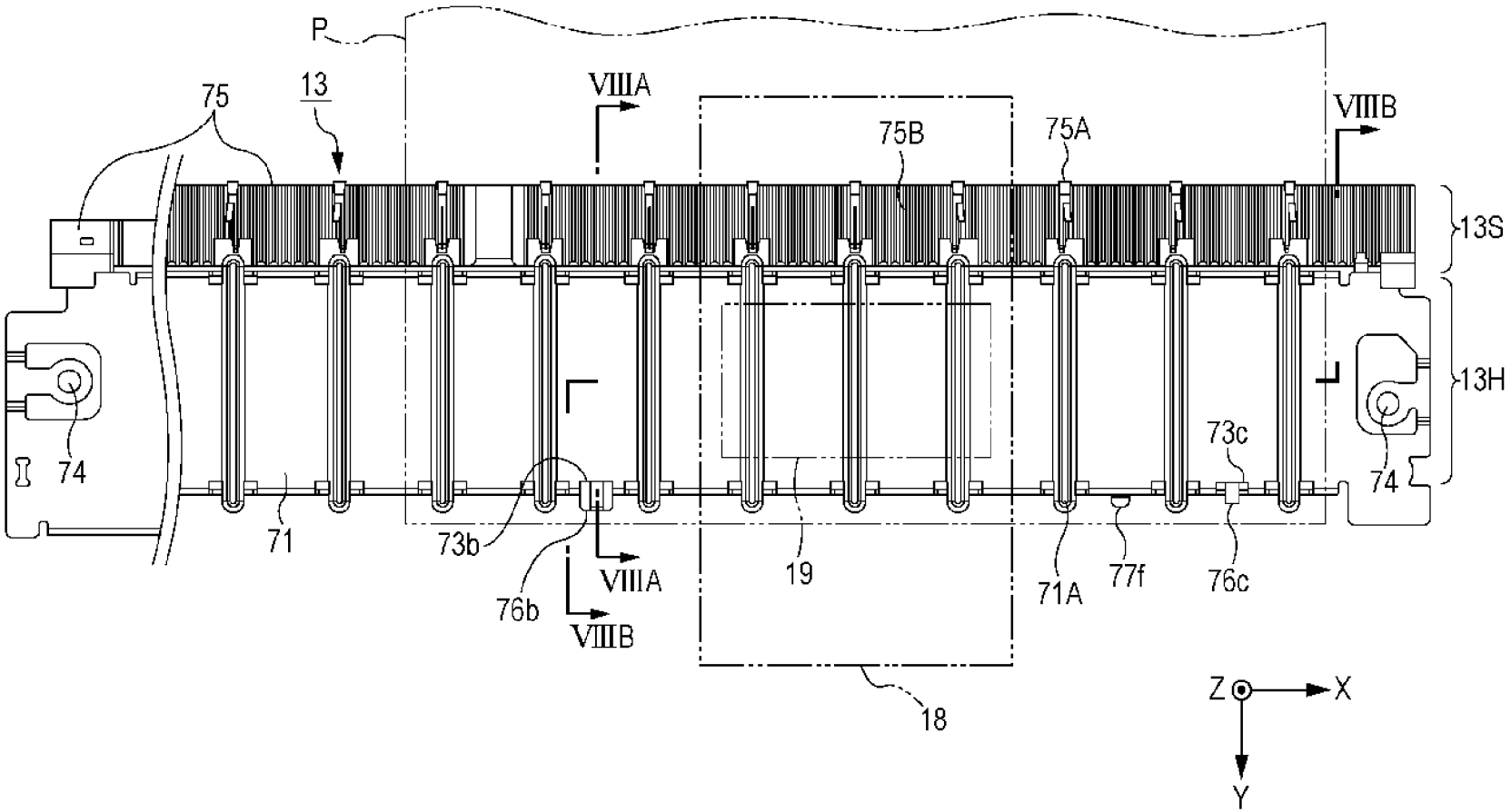
FIG. 7 is a partial plan view of the support base when viewed from above and is a schematic view for illustrating a function of the support base.

When the carriage 18 reciprocates, in the scanning direction, on the support base 13 and ejects the ink onto the paper sheet P to perform printing, the paper sheet P is transported, over the support base 13, in the transporting direction Y, as illustrated in FIG. 7. In this case, a plurality of the concave/convex surface areas 75B which is provided in the sensor moving area 13S of the sub-support base 75, over which the paper width detecting sensor (not shown) installed on the carriage 18 scans, exhibit optical reflectance (low optical reflectance, in this case) different from an optical reflectance of the transported paper sheet P. Thus, the paper width detecting sensor easily detects edges of the paper sheet P in the width direction.

Basically, in this embodiment, any configuration can be applied as long as the optical reflectance of which intensity is different from intensity of the optical reflectance of the paper sheet P is ensured in the concave/convex surface area 75B. Thus, contrary to the configuration described above, the concave/convex surface area 75B may be configured such that the concave/convex surface area 75B is constituted by a mirror surface, and thus an optical reflectance greater than the optical reflectance of the paper sheet P may be obtained.

Figure 8A:
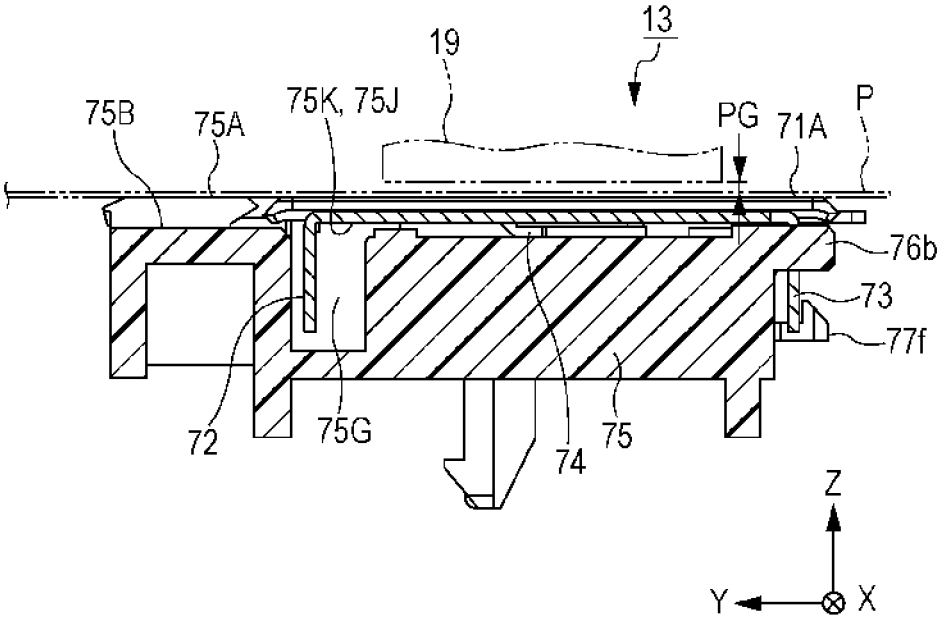
FIG. 8A is a cross-sectional view taken along the line VIIIA-VIIIA in FIG. 7
Figure 8B:
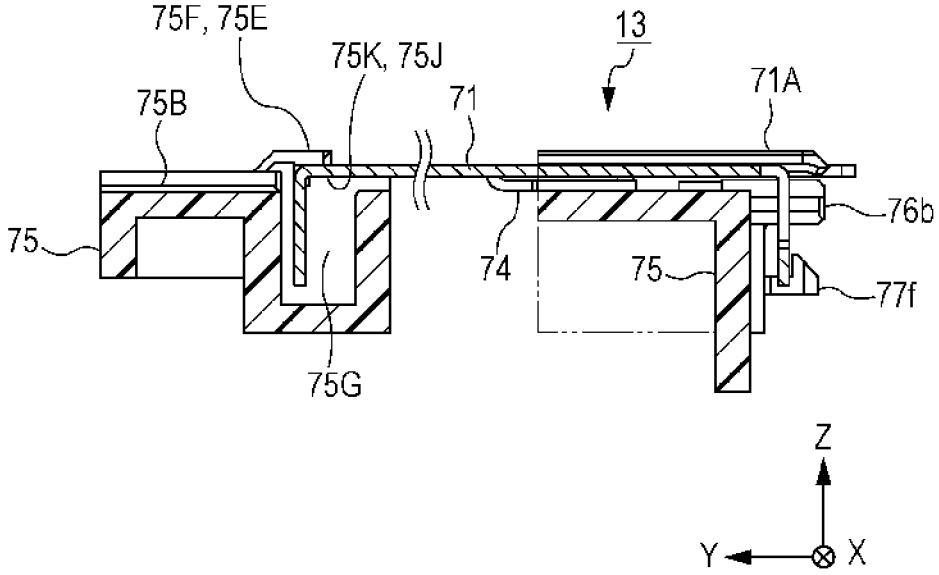
FIG. 8B is a cross-sectional view taken along the line VIIIB-VIIIB in FIG. 7.

In a state where the main support base 71 is fixed to the main body frame 12 through the fixing portion 74, an appropriate support base gap PG is provided between the upper surface of the projecting portion 71A of the main support base 71 and the liquid ejecting head 19, in accordance with a thickness of the paper sheet P or the like, as illustrated in FIG. 8A. Therefore, in a state where an appropriate gap is provided between the paper sheet P and the liquid ejecting head 19, the transported paper sheet P moves over the upper surface of the plate-shaped ribs 75A of the sub-support base 75 and the upper surface of the projecting portion 71A of the main support base 71, and thus printing is correctly performed on the paper sheet P.

In this case, the static electricity generated in the sub-support base 75 and the main support base 71 due to rubbing of the paper sheet P flows through the sub-support base 75 and the main support base 71 which are formed using a material having conductivity. Then, the static electricity is drained to the main body frame 12 through the fixing portion 74 of the main support base 71. Accordingly, the generated static electricity flows from the support base 13 to the main body frame 12, and thus it is possible to suppress, for example, scattering of paper dust caused by the static electricity.

The sub-support base 75 can move, in the scanning direction, relative to the main support base 71 which is fixed to the main body frame 12. In other words, the second protrusion portion 76*b* of the sub-support base 75 is inserted into the second hole portion 73*b* almost without having a gap, as illustrated in FIG. 7. Therefore, relative movement of the sub-support base 75 is regulated in the scanning direction and the up and down direction. However, the first protrusion portion 76*a* and the third protrusion portion 76*c* are inserted into the first hole portion 73*a* and the third hole portion 73*c*, with a gap in the scanning direction, one by one. Furthermore, in the upper surface side of the sub-support base 75, movement of the sub-support base 75, relative to the main support base 71, is prevented in the up and down direction by the second eave portion 75F (the first eave portion 75E) and the second rib-shaped portion 75K (the first rib-shaped portion 75J) but is not prevented in the scanning direction, as illustrated in FIGS. 8A and 8B. Further, movement of the sub-support base 75 is prevented in the transporting direction Y by the second eave portion 75F (the first eave portion 75E) and the second hook portion 77*f* (the first hook portion 77*e*) of the sub-support base 75 but is not prevented in the scanning direction. Accordingly, the sub-support base 75 can move, relative to the main support base 71, in the scanning direction with the second protrusion portion 76*b*, which is provided in the substantially middle portion in the scanning direction, as a center.

Meanwhile, in a case where a temperature change, such as an increase in temperature, occurs in the printer 11, in terms of an expansion/contraction rate (a dimensional change) due to temperature or humidity, the rate of the sub-support base 75 which is constituted by a resin material is greater than that of the main support base 71 which is constituted by a metallic material. Thus, a dimensional difference is caused in the sub-support base 75, relative to the main support base 71. At this time, the sub-support base 75 can relatively move in the scanning direction, that is, the longitudinal direction, and thus a force (for example, a bending force) acting on the main support base 71 is suppressed. Also, in an upper surface side of the sub-support base 75, movement of the sub-support base 75, relative to the main support base 71, is prevented in the up and down direction, and thus the sub-support base 75 can relatively move in a down direction (the −Z direction) of the up and down direction. As a result, even when the dimensional difference is caused, due to expansion and contraction of the member, between the sub-support base 75 and the main support base 71, the sub-support base 75 moves relative to the main support base 71 so as to prevent a force, which causes the main support base 71 to be deformed to be bent in the up and down direction, from being generated. Accordingly, it is possible to suppress a change in the support base gap PG.

A maintenance unit 50 for performing a maintenance operation, such as cleaning and flushing of the liquid ejecting head 19, and the like, is disposed in a maintenance area MA which is located in a right end portion in the main body frame 12 of the printer 11 (see FIG. 2).

Figure 9:
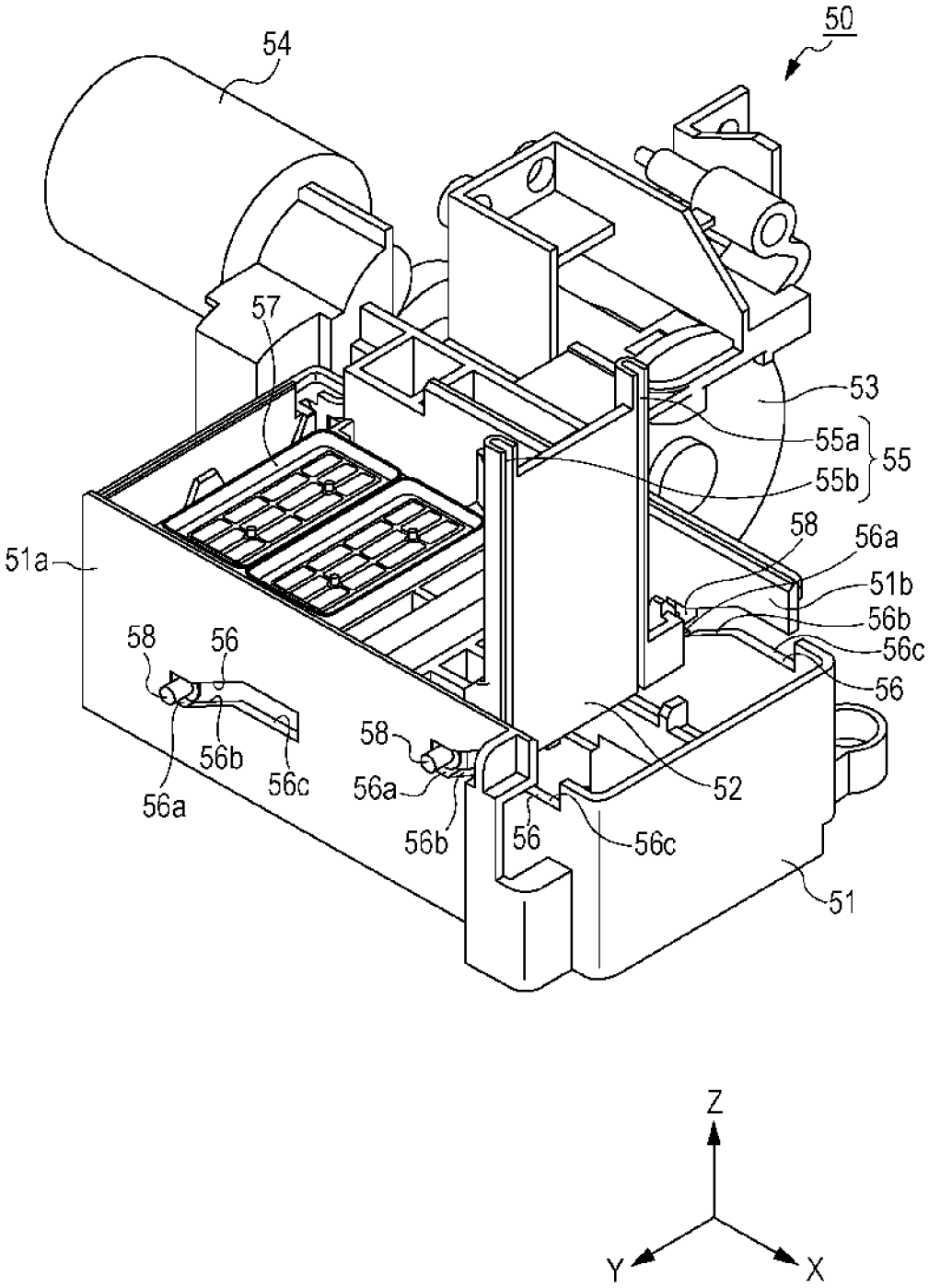
FIG. 9 is a perspective view illustrating a maintenance unit of the printer, which includes a slide body.

The maintenance unit 50 includes a case 51 having a bottomed rectangular box shape and a slide body 52 which is located in a substantially middle portion in the case 51 and rises in accordance with movement of the carriage 18 to the maintenance area MA, as illustrated in FIG. 9. The slide body 52 has a cap member 57 having a bottomed rectangular box shape. The cap member 57 abuts, from a down side of the vertical direction (the up and down direction) perpendicular to the scanning direction (the right and left direction), on the liquid ejecting head 19 with a biasing force, such that the nozzles 24 are surrounded by the cap member 57 in the maintenance area MA. In this embodiment, the slide body 52 has a substantially box-like shape. The cap member 57 is held by a left side of the cap member 57, via an elastic member (not illustrated), and thus a part of the slide body 52 functions as a cap holding portion.

The maintenance unit 50 includes a tube pump 53 which is used for sucking an inside of the cap member 57 through a flexible tube (not illustrated) and a pump motor 54 which is a driving source of the tube pump 53.

Two through grooves 56 are formed on a front wall 51*a* of the case 51, which is located on the transporting direction Y side, at intervals in the right and left direction, that is, the scanning direction. In two through grooves 56, the through groove 56 on a left side is disposed lower than the through groove 56 on the right side. Furthermore, another two through grooves 56 are also formed on a rear wall 51*b* of the case 51, which is located on a side (the −Y side) opposite the transporting direction Y side so as to face, in the front and rear direction, the two through grooves 56 formed on the front wall 51*a*. Therefore, in total, four through grooves 56 are formed on the case 51.

Each through groove 56 includes a lower flat portion 56*a*, an inclined surface portion 56*b*, and an upper flat portion 56*c*. The lower flat portion 56*a* horizontally extends from a left side to the right side (in the X direction). The inclined surface portion 56*b* extends, toward the right side, obliquely upward from a right end of the lower flat portion 56*a*. The upper flat portion 56*c* horizontally extends from a right end of the inclined surface portion 56*b* to the right side (in the X direction). In each through groove 56, the lower flat portion 56*a*, the inclined surface portion 56*b*, and the upper flat portion 56*c* communicate with each other.

In total, four support bars 58 which extend in the front and rear direction are provided on the slide body 52 to correspond to the respective through grooves 56 such that each support bar 58 is inserted into each through groove 56. The support bar 58 which is inserted into the through groove 56 is slidable in the through groove 56. Furthermore, the abutment portions 55 are provided on a right end portion of the slide body 52. When the carriage 18 moves in the right direction (the X direction) along the scanning direction so as to move from the printing area PA to the maintenance area MA, the abutment portions 55 abut on the portions to be abutted 22 (see FIG. 3) which are provided on a right side surface of the carriage 18.

In other words, the abutment portions 55 extend in the up and down direction and are disposed at an interval in the transporting direction Y perpendicular to the scanning direction. The abutment portions 55 are constituted by a first abutment portion 55*a* and a second abutment portion 55*b*. Cross-sectional surfaces of the first abutment portion 55*a* and the second abutment portion 55*b* have a U shape in which a curved portion is directed to the left side (the −X direction side). The first abutment portion 55*a* abuts on the first portion to be abutted 22*a* and the second abutment portion 55*b* abuts on the second portion to be abutted 22*b*. In this embodiment, the first abutment portion 55*a* and the second abutment portion 55*b* which constitute the abutment portions 55 abut on the first portion to be abutted 22*a* and the second portion to be abutted 22*b* one by one, at a position in which the first abutment portion 55*a* and the second abutment portion 55*b* are separated, by the same distance, from the sliding surface 35 in a direction perpendicular to the sliding surface 35. The abutment portions 55 (the first abutment portion 55*a* and the second abutment portion 55*b*) are formed integrally with the cap holding portion which holds the cap member 57 via the elastic member.

Figure 10:
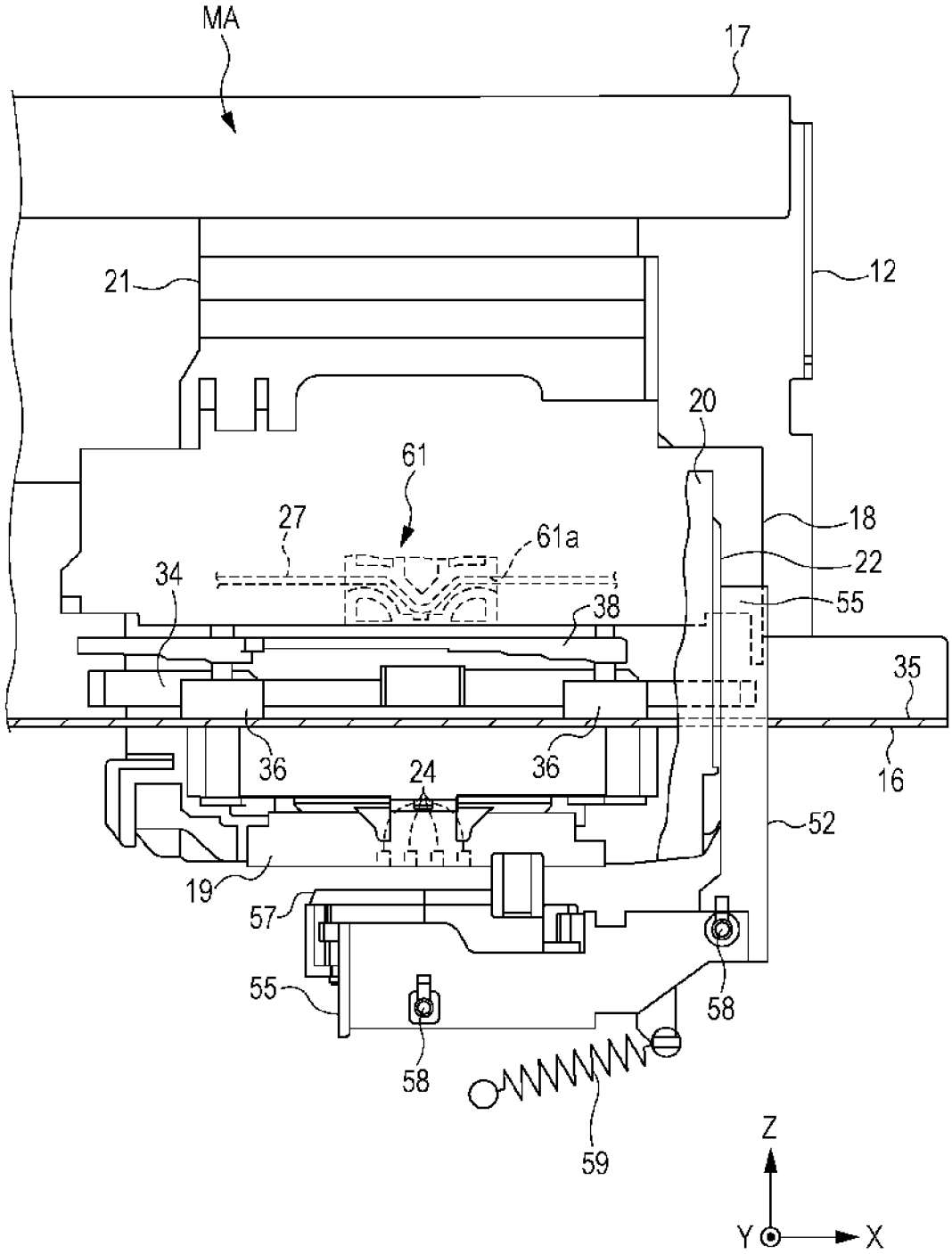
FIG. 10 is a schematic front view illustrating a state of the slide body immediately after the slide body abuts on the carriage.

The slide body 52 is normally biased, by an extension coil spring 59, to the left side in the case 51, as illustrated in FIGS. 9 and 10. In a printing state where the carriage 18 is not positioned in the maintenance area MA, each support bar 58 is positioned in the lower flat portion 56*a*, that is, the left most side, in each through groove 56, by the biasing force of the extension coil spring 59. In other words, when the carriage 18 is positioned in the printing area PA, the slide body 52 descends in the case 51.

In this case, in the position adjusting mechanism of this embodiment, the convex portions 37 of the sliding member 34 respectively abut on the fourth cam surfaces 39*d* of the cam member 38, and thus the carriage 18 is located in the uppermost position. In other words, the connection portion 61 to which the driving belt 27 is connected is located farthest apart from the sliding surface 35 in an up direction.

In this state, when the carriage 18 moves from the left side to the right side so as to move from the printing area PA to the maintenance area MA, by a moving force caused by rotation of the driving belt 27 driven by the carriage motor 28, the portion to be abutted 22 of the carriage 18 abuts on the abutment portion 55 of the slide body 52, as illustrated in FIG. 10. In a state where the carriage 18 abuts on the slide body 52, the slide body 52 moves, along with the carriage 18, in the right direction (the X direction).

In other words, when the carriage 18 moves from the left side to the right side in the maintenance area MA, the slide body 52 moves from the left side to the right side in the case 51 in a state where the slide body 52 is pressed, by the carriage 18, against the biasing force of the extension coil spring 59. As a result, each support bar 58 slides in each through groove 56 from the left side to the right side in a state where the abutment portion 55 abuts on the portion to be abutted 22 of the carriage 18. The support bar 58 moves from the lower flat portion 56*a* to the upper flat portion 56*c* through the inclined surface portion 56*b*. Therefore, the slide body 52 moves obliquely upward toward the right side in a state where a posture of the slide body 52 is maintained to be stable in the parallel direction.

Figure 11:
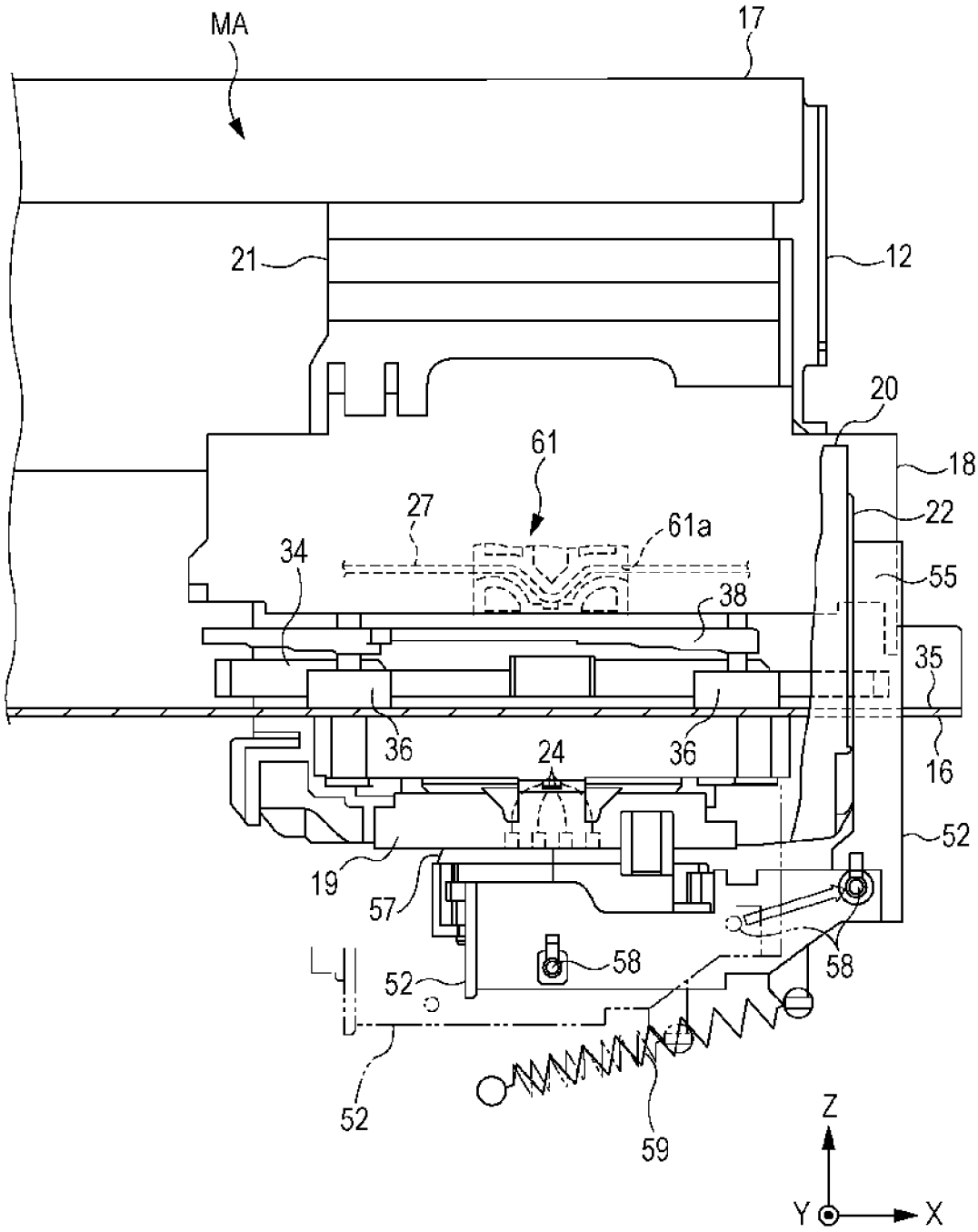
FIG. 11 is a schematic front view illustrating a state of the slide body when the slide body moves in a state where the slide body abuts on the carriage and a cap member abuts on the liquid ejecting head.

When the slide body 52 moves obliquely upward toward the right side, the cap member 57 gradually ascends to approach the liquid ejecting head 19, as illustrated by a white arrow in FIG. 11. Then, in a state where each support bar 58 reaches the upper flat portion 56*c* of each through groove 56, the cap member 57 abuts on the liquid ejecting head 19 from a down side of the up and down direction perpendicular to the right and left direction (the scanning direction) so as to surround the nozzles 24. In other words, the liquid ejecting head 19 is capped with the cap member 57.

As described above, a position of the carriage 18 when the slide body 52 ascends, that is, when each support bar 58 located in the upper flat portion 56*c* of each through groove 56, that is, a position of the carriage 18 when the liquid ejecting head 19 is capped with the cap member 57 is a capping position which is one of reference positions. A position of the cap member 57 in this state is an abutment position.

When the slide body 52 moves to the right side in a state where the abutment portion 55 abuts on the carriage 18, a magnitude of the biasing force of the extension coil spring 59, which is applied to the slide body 52, increases because the extension coil spring 59 is extended. Therefore, a magnitude of a reaction force of the abutment portion 55, which acts on the carriage 18, increases in accordance with the movement of the carriage 18. Thus, a load which causes the slide body 52 to move, that is, the moving force which causes the carriage 18 to move, increases.

Meanwhile, in this embodiment, when the tube pump 53 is driven in a state (a state illustrated in FIG. 11) where the cap member 57 abuts on the liquid ejecting head 19 so as to surround the nozzles 24, a space which is surrounded by the cap member 57 and the liquid ejecting head 19 is subjected to suction through a flexible tube (not illustrated). Therefore, a negative pressure is generated in the space. A so-called cleaning operation in which the thickened ink in the liquid ejecting head 19 and air bubbles are drained from each nozzle 24, through the cap member 57 and the flexible tube (not illustrated), to a waste liquid tank (not illustrated) is performed using this negative pressure.

In a state where the slide body 52 descends, that is, in a state (a state illustrated in FIG. 10) where each support bar 58 is located in lower flat portion 56*a* of each through groove 56, a position of the carriage 18 when the liquid ejecting head 19 faces the cap member 57 in the up and down direction is a head facing position which is one of reference positions. In this case, the cap member 57 is located in a retreated position in which the cap member 57 is separated from the liquid ejecting head 19. When, during printing, a flushing operation is regularly performed to forcibly discharge the ink from the liquid ejecting head 19 to an inner portion of the cap member 57, the carriage 18 moves from the printing area PA to the head facing position. In other words, the flushing operation during printing is performed as follows. In a state where the carriage 18 is moved to the head facing position, the ink is ejected to the cap member 57 which is located in the retreated position.

In a state where the carriage 18 is located in the capping position, that is, a state where the cap member 57 abuts on the liquid ejecting head 19, a position in which the abutment portion 55 abuts on the carriage 18 is located further on the anti-gravity direction side (the Z direction side) in a direction perpendicular to the sliding surface 35 than a position of the connection portion 61 to which the driving belt 27 is connected, as illustrated in FIG. 11. More specifically, it is preferable that a position in which the abutment portion 55 abuts on the carriage 18 be located higher than a Z-direction position of the driving belt 27 in an end 61*a* of the connection portion 61, which is located on the abutment portion 55 side. This is because the carriage 18 rotates about the end 61*a* as a fulcrum. In this embodiment, an upper end portion (a tip portion) of the abutment portion 55 in a direction perpendicular to the sliding surface 35 abuts on the carriage 18. In other words, the abutment portion 55 has a shape in which an upper end portion of the abutment portion 55 is a portion which abuts on the portion to be abutted 22 of the carriage 18, for example, a protruding portion which protrudes slightly more than other portions being formed on the upper end portion of the abutment portion 55.

In this embodiment, in a state where the carriage 18 is located in the head facing position, that is, a state where the cap member 57 is separated from the liquid ejecting head 19, the position in which the abutment portion 55 abuts on the carriage 18 (the portion to be abutted 22) is located, in terms of a direction perpendicular to the sliding surface 35, further on the gravity direction side, that is, lower than the position of the connection portion 61, as illustrated in FIG. 10. In this embodiment, the position of the connection portion 61 is a position in which the moving force from the driving belt 27 is applied to the connection portion between the carriage 18 and the driving belt 27, that is, a connection position between the carriage 18 and the driving belt 27 on the right direction (the X direction) side.

A drive switching mechanism which performs driving of the transporting roller and driving of the paper feeding roller of the paper feeding mechanism, using the movement of the carriage 18 is applied to this embodiment. The drive switching mechanism will be described with reference to the accompanying drawings.

Figure 12:
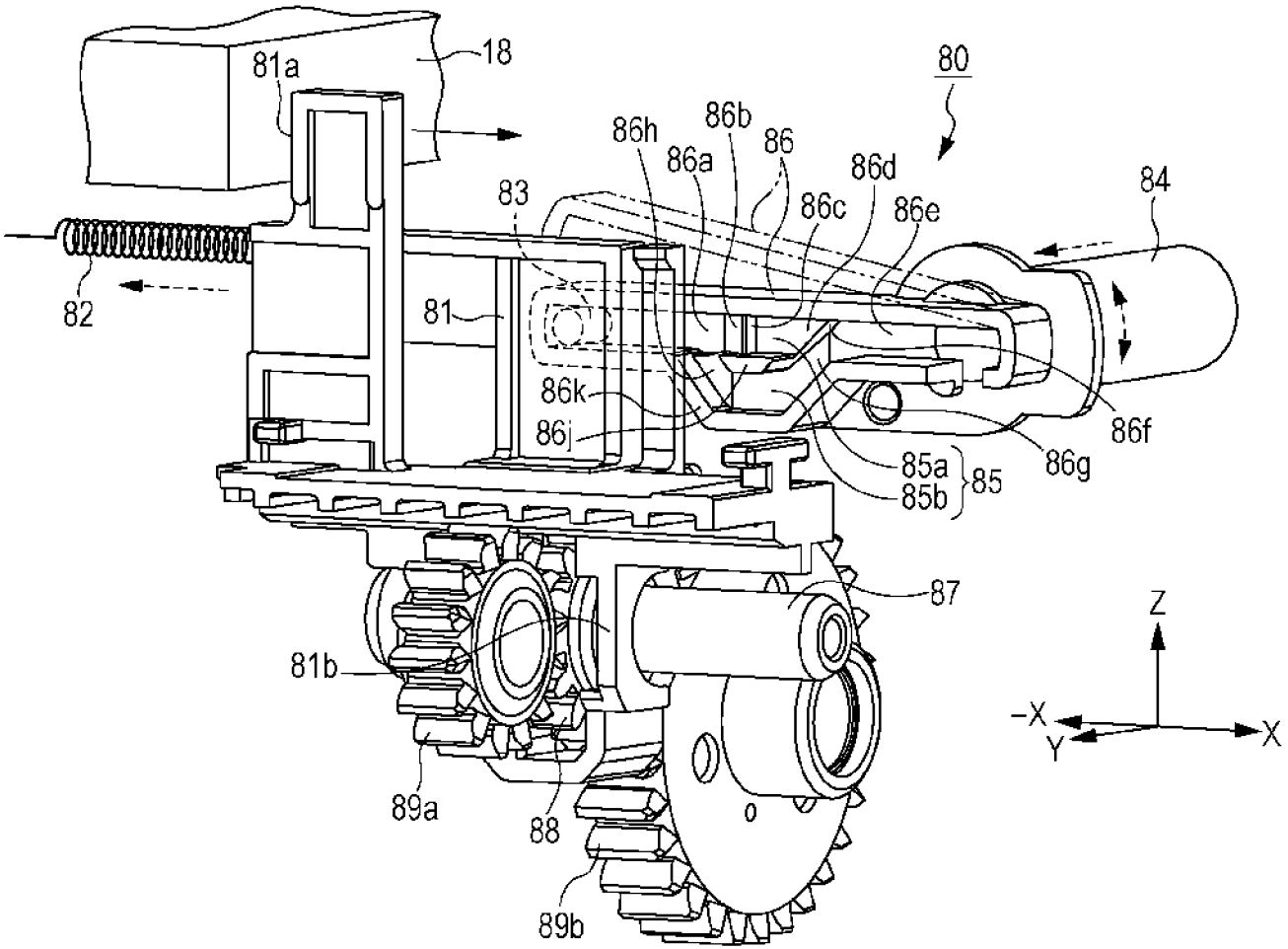
FIG. 12 is a perspective view illustrating a drive switching mechanism which switches drive transmission to a paper feeding mechanism.

A drive switching mechanism 80 includes a moving member 81 and a cam structure member 86, as illustrated in FIG. 12. An abutment portion 81*a* on which the carriage 18 abuts is provided on an upper portion of the moving member 81. A cam groove 85 in which a cam pin 83 formed on the moving member 81 slides is formed on in the cam structure member 86. The moving member 81 is normally biased, by a biasing member 82 such as a tension spring, to the left side (to the −X direction side) of the scanning direction, as illustrated by the dashed arrow in FIG. 12. Therefore, in a state where the carriage 18 moves to the right side (the X direction side) of the scanning direction), as illustrated by the solid arrow in FIG. 12, and abuts on the abutment portion 81*a*, the moving member 81 reciprocates, along with the carriage 18, in the scanning direction in a state where the moving member 81 is guided by a rail member (not illustrated.

A gear holding portion 81*b* is provided on a lower portion of the moving member 81, which is located opposite the abutment portion 81*a* between the carriage 18 and the moving member 81. The gear holding portion 81*b* holds a transmission gear 88, which is installed to be rotatable about a slide shaft 87 having an axis direction parallel to the scanning direction, in such a manner that the gear holding portion 81*b* pinches the transmission gear 88 from both sides in the scanning direction such that the transmission gear 88 can move along an axis of the slide shaft 87. Therefore, the moving member 81 causes the transmission gear 88 held by the gear holding portion 81*b* to move along the axis of the slide shaft 87 in such a manner that the moving member 81 moves, along with the carriage 18, in the scanning direction.

In this embodiment, in a state where the carriage 18 does not abut on the moving member 81, the transmission gear 88 is meshed with both a first gear 89*a* and a second gear 89*b*, and thus rotation is transmitted between the first gear 89*a* and the second gear 89*b*. Accordingly, when the first gear 89*a* is driven to rotate in accordance with driving of the transporting roller, the rotation of the first gear 89*a* is transmitted by the transmission gear 88, and thus the second gear 89*b* rotates. As a result, the paper feeding roller is also driven.

Meanwhile, when the carriage 18 abuts on the moving member 81 and the moving member 81 moves, along with the carriage 18, to the right side (the X direction side) of the scanning direction, the transmission gear 88 is released from both the first gear 89*a* and the second gear 89*b*. Therefore, rotation is not transmitted between the first gear 89*a* and the second gear 89*b*. Thus, for example, when the first gear 89*a* is driven to rotate in accordance with driving of the transporting roller, the rotation of the first gear 89*a* is not transmitted to the second gear 89*b*. As a result, the paper feeding roller is not driven.

As described above, the drive switching mechanism 80 is configured such that the drive switching mechanism 80 switches driving of the transporting roller and driving of the paper feeding roller of the paper feeding mechanism to each other in such a manner that the drive switching mechanism 80 controls the position of the moving member 81 in the scanning direction, using the movement of the carriage 18. The position of the moving member 81 in the scanning direction is controlled by a cam mechanism. In other words, the position of the moving member 81 in the scanning direction is controlled by the cam mechanism which includes the cam pin 83 formed on the moving member 81 and the cam groove 85 which is formed on the cam structure member 86 and allows the cam pin 83 to slide therein.

The cam groove 85 is partitioned by an external wall 86*k* extending substantially along an outer edge of the cam structure member 86 and an internal wall 86*j* which is provided inside the external wall 86*k* to have an island shape. The cam groove 85 is formed to have a first cam groove portion 85*a* and a second cam groove portion 85*b* which are open to the transporting direction Y side. The first cam groove portion 85*a* substantially linearly extends in the scanning direction. The second cam groove portion 85*b* is constituted by a linear portion and inclination portions which are disposed below the first cam groove portion 85*a* when viewed from a front side in the transporting direction Y. The linear portion extends in the scanning direction and is shorter than the first cam groove portion 85*a*. The inclination portions are connected to both ends of the linear portion in the scanning direction and allows the linear portion to be connected to the first cam groove portion 85*a*.

A bottom surface portion of the cam groove 85, which is surface located opposite the transporting direction, has predetermined concave/convex shapes along the scanning direction. In other words, a first flat surface 86*a*, a first inclined surface 86*b* which inclines gradually upward from the first flat surface 86*a*, a first wall surface 86*c* which is perpendicular to the bottom surface, a second flat surface 86*d*, and a third flat surface 86*e* which is dented lower than the second flat surface 86*d* are provided on a bottom surface of the first cam groove portion 85*a*, in order from the left side (the −X direction side) to the right side (the X direction side). A second inclined surface 86*g* which inclines gradually upward from the third flat surface 86*e* and a fourth flat surface 86*h* are provided on a bottom surface of the second cam groove portion 85*b*, in order from the right side (the X direction side) to the left side (the −X direction side). A second wall surface 86*f* which is perpendicular to the bottom surface and inclines gradually downward toward the left side is formed between the second flat surface 86*d* of the first cam groove portion 85*a* and the second inclined surface 86*g* of the second cam groove portion 85*b*.

The cam pin 83 moves in the cam groove 85, which is formed as described above, in a state where the cam pin 83 abuts on the bottom surface of the cam groove 85. When the cam pin 83 slides in the second cam groove portion 85*b*, the second cam groove portion 85*b* is lifted, in terms of the vertical direction, to the position of the cam pin 83. In other words, in this embodiment, a rotation shaft portion 84 having an axis parallel to the transporting direction Y is provided on a right end portion of the cam structure member 86. The rotation shaft portion 84 is biased in the transporting direction, that is, to the moving member 81 side, by a biasing member (not illustrated), as illustrated by the dashed single-headed arrow in FIG. 12. In addition, the rotation shaft portion 84 can oscillate about the rotation shaft portion 84 as a center, as illustrated by the dashed double-headed arrow in FIG. 12. When the cam pin 83 slides in the second cam groove portion 85*b*, the cam structure member 86 oscillates as illustrated by the two-dot chain line in FIG. 12.

Figure 13:
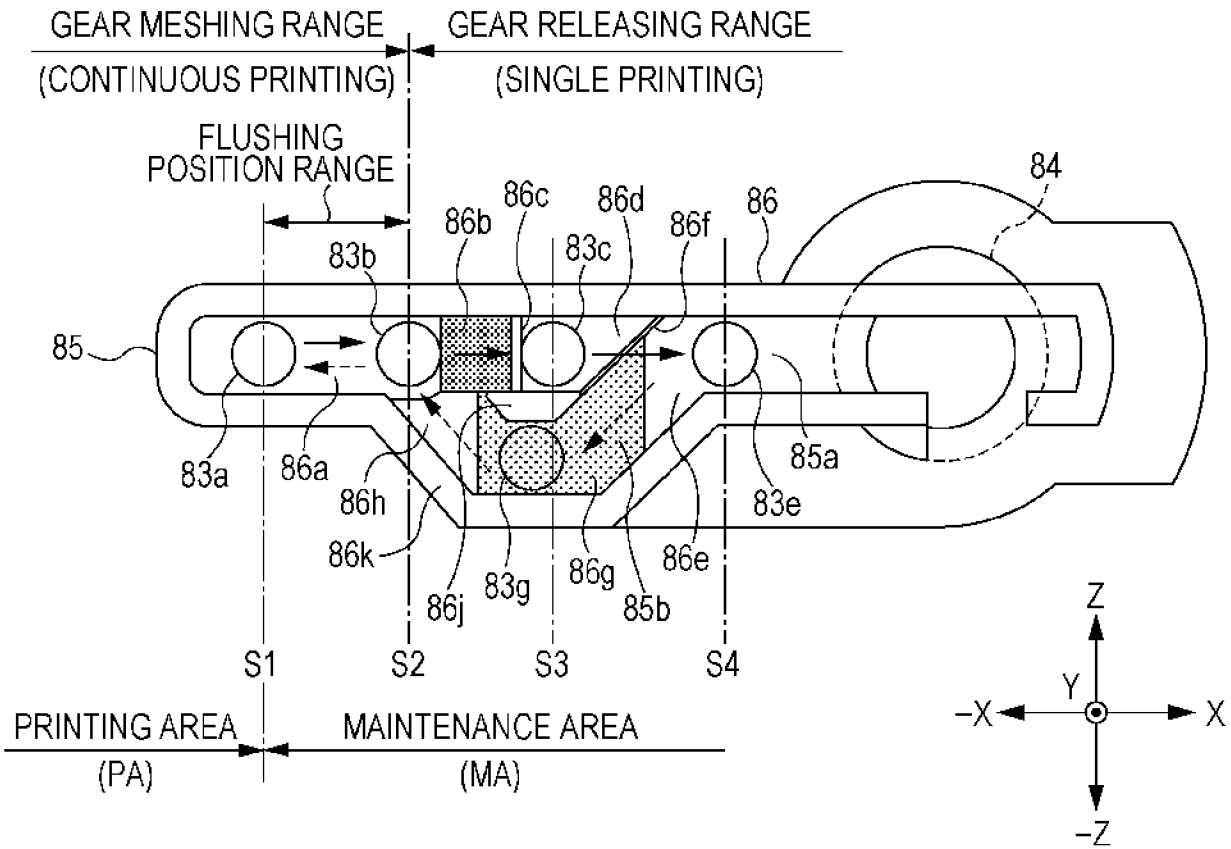
FIG. 13 is a schematic view illustrating an operation of a cam mechanism in the drive switching mechanism.

Next, an operation of the drive switching mechanism 80 will be described with reference to FIGS. 13 to 14B. In this embodiment, as illustrated in FIG. 13, when the moving member 81 is moved by the carriage 18, the cam pin 83 moves to positions which are illustrated in FIG. 13 by the reference numerals and letters 83*a* to 83*g*. FIG. 13 illustrates a state where the cam pin 83 moves in the up and down direction, relative to the cam structure member 86. The carriage 18 and the biasing member 82 are not illustrated in FIGS. 14A and 14B.

First, in an S1 position in which the carriage 18 moves to the right side (the X direction side) of the scanning direction, and thus the carriage 18 moves from the printing area PA to the maintenance area MA, the carriage 18 abuts on the moving member 81. Accordingly, when the carriage 18 starts to move, the cam pin 83 starts to move along the first flat surface 86*a* from the S1 position, which is indicated by the reference numeral and letter 83*a*, to the X direction side. As a result, the cam pin 83 moves to an S2 position which is indicated by the reference numeral and letter 83*b* and in which the cam pin 83 comes into contact with the first inclined surface 86*b*.

Figure 14A:
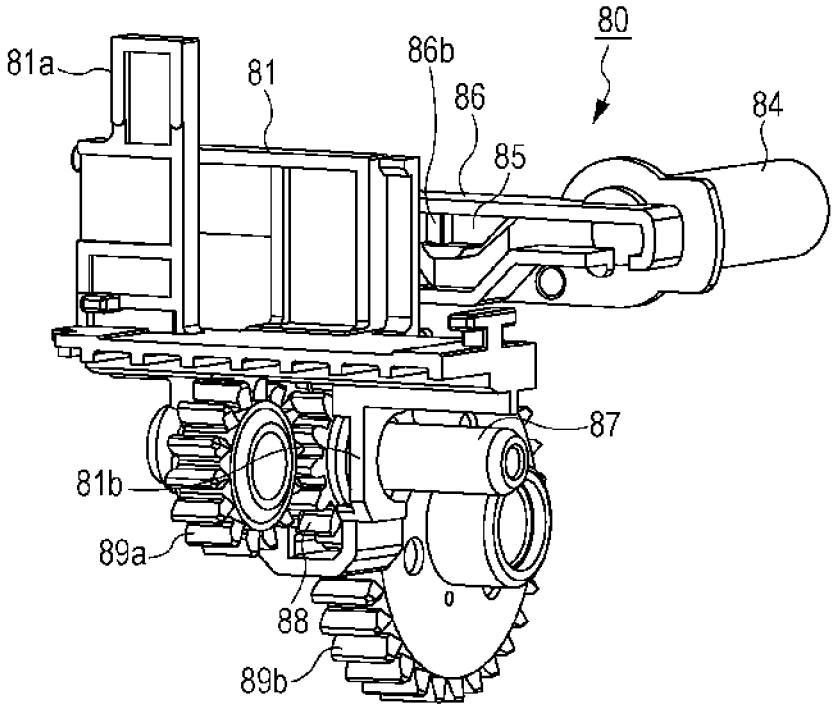
FIG. 14A is a perspective view illustrating the drive switching mechanism in a state where a transmission gear is meshed and FIG. 14B is a perspective view illustrating the drive switching mechanism in a state where the transmission gear is released.

In the printer 11 of this embodiment, when the cam pin 83 moves between the S1 position and the S2 position, the transmission gear 88 moves along the slide shaft 87 but the transmission gear 88 is still meshed with both the first gear 89*a* and the second gear 89*b*, as illustrated in FIG. 14A. Therefore, for example, when the first gear 89*a* is driven to rotate, it is possible to rotate the second gear 89*b*.

As a result, a range from the S1 position to the S2 position is a gear meshing range, as illustrated in FIG. 13. In this range, the printer 11 can perform a continuous printing operation by driving both the transporting roller and the paper feeding roller. Therefore, in a state where the cam pin 83 is located in any position within the range from the S1 position to the S2 position, when flushing is performed during printing, it is possible to suppress noise caused when the transmission gear 88 is meshed with the first gear 89*a* and the second gear 89*b*, because a meshed state of the transmission gear 88 is not released. Furthermore, in a case where a flushing position is set to be within the maintenance area MA, a movement range of the carriage 18 when the carriage 18 moves to the flushing position, that is the head facing position in which the liquid ejecting head 19 faces the cap member 57 in the up and down direction, can be set to be overlapped with the maintenance area MA. As a result, it is possible to prevent the maintenance area MA, except the printing area PA, from being widened, and thus it is possible to prevent the printer 11 from increasing in size.

Subsequently, when the carriage 18 moves further to the X direction side of the scanning direction, the cam pin 83 moves, on the first inclined surface 86*b* in the first cam groove portion 85*a*, from the S2 position indicated by the reference numeral and letter 86*b* to the X direction side. Accordingly, the cam pin 83 moves to an S3 position which is indicated by the reference numeral and letter 83*c* and in which the cam pin 83 abuts on a right side of the first wall surface 86*c*.

Figure 14B:
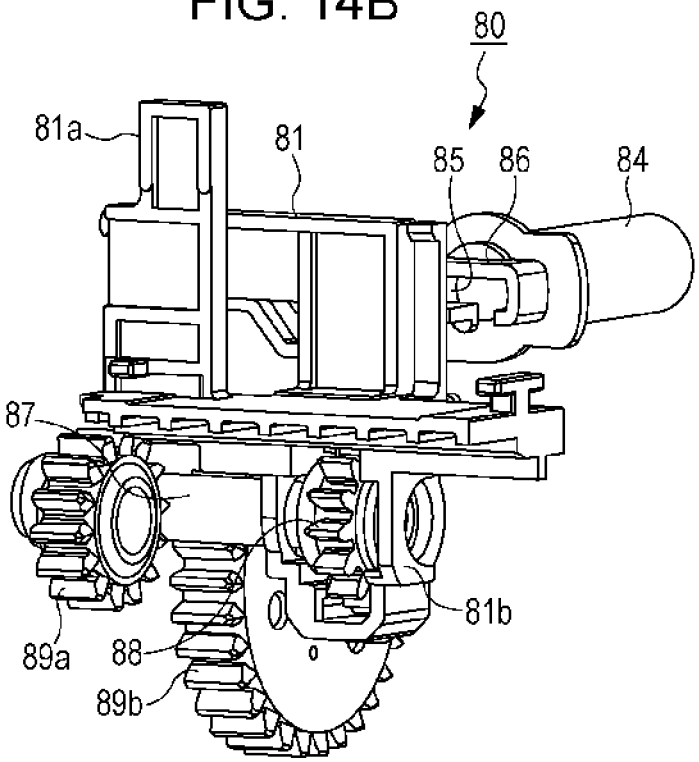

In the printer 11 of this embodiment, when the cam pin 83 is located in the S3 position, the transmission gear 88 moves along the slide shaft 87, and thus the meshed state of the transmission gear 88 with both the first gear 89*a* and the second gear 89*b* is released, as illustrated in FIG. 14B. Accordingly, for example, even when the first gear 89*a* is driven to rotate, the second gear 89*b* does not rotate.

As a result, when the cam pin 83 starts to move from the S2 position, the cam pin 83 is located in a gear releasing range in which the meshed state of the transmission gear 88 with both the first gear 89*a* and the second gear 89*b* is released, as illustrated in FIG. 13. When the cam pin 83 is located within the gear releasing range, the printer 11 can perform a single printing operation by driving the transporting roller and not driving the paper feeding roller. In addition, when the cam pin 83 (the cam pin 83*c*) is located in the S3 position indicated by the reference numeral and letter 83*c*, movement of the cam pin 83 to the left side (the –X direction side) is prevented by the first wall surface 86*c*. Thus, a state in which the transmission gear 88 is not meshed with both the first gear 89*a* and the second gear 89*b* is reliably maintained.

Therefore, when the printer 11 switches the printing operation from the single printing operation to the continuous printing operation, it is necessary to move the cam pin 83 from the S3 position to the S2 position or the S1 position. In this case, first, the printer 11 causes the moving member 81 to move to the right side (the X direction side) by moving the carriage 18, and then causes the cam pin 83 to move, on the second flat surface 86*d* in the first cam groove portion 85*a*, from the S3 position indicated by the reference numeral and letter 83*c* to the X direction side. Subsequently, the printer 11 causes the cam pin 83 to move to the S4 position on the third flat surface 86*e*, which is indicated by the reference numeral and letter 83*e*. Next, the printer 11 causes the carriage 18 to move to the left side (the –X direction side), and thus the cam pin 83 moves to the left side by the biasing member 82. Therefore, the cam pin 83 moves from the first cam groove portion 85*a* to the second cam groove portion 85*b* in a state where the cam pin 83 abuts on the second wall surface 86*f*. As a result, the cam pin 83 moves on the second inclined surface 86*g* in a direction indicated by the dashed arrow, and passes through the fourth flat surface 86*h*, and then reaches the first flat surface 86*a*, as indicated by the reference numeral and letter 83*g* in FIG. 12.

In this way, the cam pin 83 returns to the S1 position indicated by the reference numeral and letter 83*a* or the S2 position indicated by the reference numeral and letter 83*b*. The above-described operation (motion) is repeated in such a manner that the carriage 18 moves to the X direction side again and abuts on the abutment portion 81*a*. In this embodiment, the abutment portion 81*a* in which the carriage 18 abuts on the moving member 81 is located, in terms of the vertical direction, lower than the abutment portions 55 of the slide body 52.

Figure 15A:
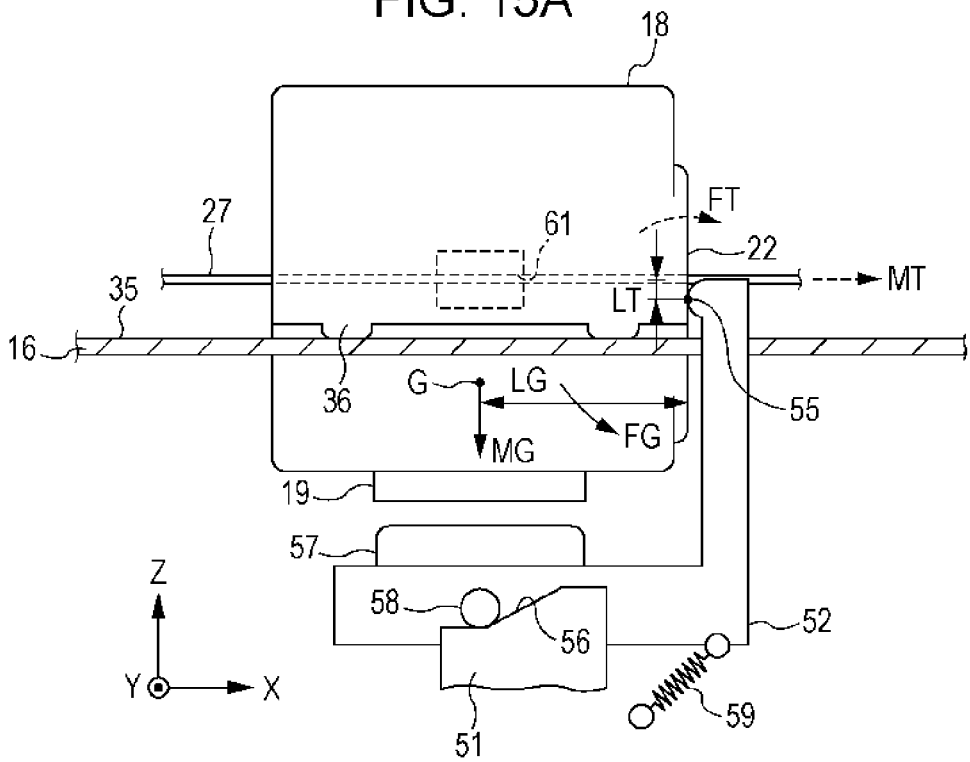
FIG. 15A is a schematic view illustrating turning forces acting on the carriage when the carriage is located at a head facing position, relative to a cap member
Figure 15B:
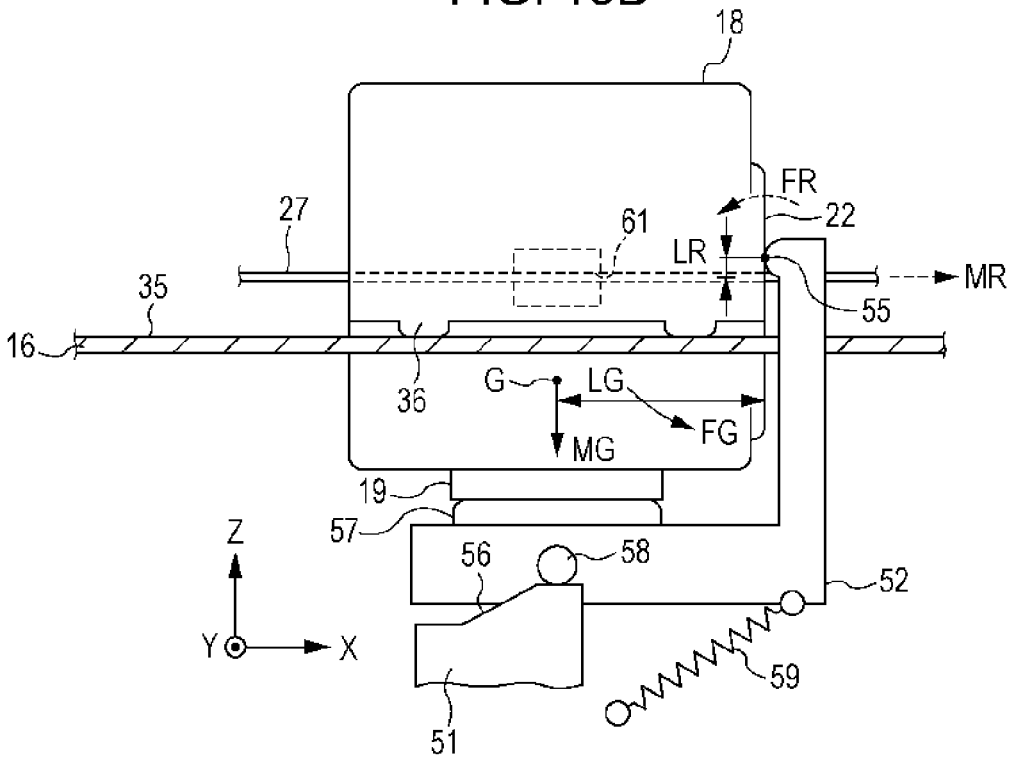
FIG. 15B is a schematic view illustrating turning forces acting on the carriage when the carriage is located at a capping position.

Next, an operation of this embodiment in which an abutment position of the abutment portion 55 on the carriage 18 is located further on the anti-gravity direction side (the Z direction side) of a direction perpendicular to the sliding surface 35 than a position of the connection portion 61 will be described with reference to FIGS. 15A and 15B. For convenience of description of the operation, FIGS. 15A and 15B schematically illustrate the drawings of FIGS. 10 and 11. The same reference numerals and letters are given to the components which are the same as those in the embodiment described above, and descriptions thereof will not be repeated.

In a state where the carriage 18 is located in the head facing position, relative to the cap member 57, as illustrated in FIG. 15A, the abutment position of the abutment portion 55 on the carriage 18 (the portion to be abutted 22) is located, in terms of a direction (in this case, the vertical direction) perpendicular to the sliding surface 35, further upward (on the Z direction) than the sliding surface 35 and further downward than the connection portion 61. Therefore, a moving force MT of the driving belt 27, which acts on the connection portion 61, is applied as a turning force FT which causes the carriage 18 to rotate, in a clockwise direction when viewed from a front side in the transporting direction Y, about an axis, which is parallel to the transporting direction Y, in the abutment position of the abutment portion 55 on the carriage 18 such that the carriage 18 is separated from the sliding surface 35, as illustrated by the dashed arrows in FIG. 15A.

The turning force FT is the product of the moving force MT of the driving belt 27, which acts on the connection portion 61, and a distance LT which is a distance, in terms of the vertical direction perpendicular to the sliding surface 35, between a position of the connection portion 61 and the abutment position of the abutment portion 55 on the carriage 18. In this case, a position of the connection portion 61, to which the moving force is applied, is a center of the driving belt 27 in the thickness direction. When the carriage 18 is located in the head facing position, the extension coil spring 59 is not in an extended state and the cap member 57 does not abut on the liquid ejecting head 19. Thus, a reaction force which is a load when moving the slide body 52 in the scanning direction is small. Therefore, the moving force MT which is applied to the carriage 18 when moving the carriage 18 along with the slide body 52 is small, and thus the turning force FT which acts on the carriage 18 is also small.

Meanwhile, the carriage 18 which is mounted on the sliding surface 35 is pressed against the sliding surface 35 by a turning force FG which is generated by its own weight MG of the carriage 18 and acts in the counter-clockwise direction when viewed from a front side in transporting direction Y, about the abutment position of the abutment portion 55 on the carriage 18, as a center, as illustrated by the solid arrows in FIG. 15A. The turning force FG is the product of its own weight MG of the carriage 18 and a distance LG which is a distance, in terms of the scanning direction parallel to the sliding surface 35, between a center of gravity G of the carriage 18 and the abutment position of the abutment portion 55 on the carriage 18. In this embodiment, the turning force FG is greater than the turning force FT. Thus, a pressing force of the carriage 18 (the slide portion 36) against the sliding surface 35 is reduced while maintaining a state in which the carriage 18 is pressed against the sliding surface 35.

Next, in a state where the carriage 18 is located in the capping position, as illustrated in FIG. 15B, the abutment position of the abutment portion 55 on the carriage 18 is located, in terms of a direction (in this case, the vertical direction) perpendicular to the sliding surface 35, further upward than the sliding surface 35 and, also, further upward than the connection portion 61. Therefore, a moving force MR of the driving belt 27, which acts on the connection portion 61, is applied as a turning force FR which causes the carriage 18 to rotate, in a counter-clockwise direction when viewed from the front side in the transporting direction Y, about an axis, which is parallel to the transporting direction Y, in the abutment position of the abutment portion 55 on the carriage 18, as illustrated by the dashed arrow in FIG. 15B. As similar to the turning force FG generated by its own weight MG of the carriage 18, the turning force FR causes the carriage 18 to be pressed against the sliding surface 35.

The turning force FR is the product of the moving force MR of the driving belt 27, which acts on the connection portion 61, and a distance LR which is a distance, in terms of the vertical direction perpendicular to the sliding surface 35, between the position of the connection portion 61 and the abutment position of the abutment portion 55 on the carriage 18. When the carriage 18 is located in the capping position, the extension coil spring 59 is in an extended state and the cap member 57 abuts on the liquid ejecting head 19. Thus, a reaction force which is a load when moving the slide body 52 in the scanning direction is great. Therefore, the moving force MR which is applied to the carriage 18 when moving the carriage 18 along with the slide body 52 is great, and thus the turning force FR which acts on the carriage 18 is also great. Thus, in this case, since, for example, the turning force FR is greater than the turning force FG, and the abutment position of the abutment portion 55 on the carriage 18 is located further on the upper side than the connection portion 61, the carriage 18 rotates in the counter-clockwise direction when viewed from the front side in the transporting direction Y. Accordingly, a state in which the carriage 18 is pressed against the sliding surface 35 is maintained.

According to the embodiment described above, it is possible to obtain the effects described below.

(1) A distance between a position in which the abutment portion 55 of the slide body 52 abuts on the carriage 18 and the sliding surface 35 is equal to or longer than a distance between the connection portion 61 in which a moving force which causes the carriage 18 to move in the scanning direction is applied to the carriage 18 and the sliding surface 35. Thus, the turning force which is generated by the reaction force of the abutment portion 55, which acts on the carriage 18 in a state where the cap member 57 abuts on the liquid ejecting head 19 from the gravity direction side, and the moving force which is applied to the carriage 18 causes the carriage 18 to be pressed against the sliding surface 35 without causing the carriage 18 to be separated from the sliding surface 35. As a result, when carriage 18 moves the slide body 52 in the scanning direction, it is possible to stably move the carriage 18 in a state where the carriage 18 is not separated from the sliding surface 35.

(2) A distance between a position in which the abutment portion 55 of the slide body 52 abuts on the carriage 18 in a state where a position of the liquid ejecting head 19 is adjusted in accordance with the thickness of the paper sheet P, for example, and the sliding surface 35 is equal to or longer than a distance between the connection portion 61 in a state where the cap member 57 abuts on the liquid ejecting head 19 and the sliding surface 35. Accordingly, it is possible to generate, with respect to the carriage 18, a turning force which causes the carriage 18 to be pressed against the sliding surface 35 without causing the carriage 18 to be separated from the sliding surface 35.

(3) In a case where the abutment position of the abutment portion 55 is located further on the gravity direction side (the −Z direction side) than the connection portion 61, a force acting in a direction in which the carriage 18 is separated from the sliding surface 35 is small. As a result, a force which causes the carriage 18 to be separated from the sliding surface 35 is small, and thus the carriage 18 can move in a state where the carriage 18 is not separated from the sliding surface 35, due to the weight (its own weight) of the carriage 18. In addition, a pressing force of the carriage 18 against the sliding surface 35 is reduced, and thus it is possible to smoothly move the carriage 18 by suppressing a frictional resistance between the carriage 18 and the sliding surface 35. Furthermore, when the carriage 18 moves until the cap member 57 abuts on the liquid ejecting head 19, the abutment portion 55 moves upward. Thus, in a state where the cap member 57 abuts on the liquid ejecting head 19, a turning force which causes the carriage 18 to be pressed against the sliding surface 35 is generated. As a result, when the carriage 18 moves the slide body 52 in the scanning direction, it is possible to stably move the carriage 18 in a state where the carriage 18 is not separated from the sliding surface 35.

(4) A plurality of the abutment portions 55 are provided, and thus it is possible to move the slide body 52 in the scanning direction, using the carriage 18, while suppressing the rotation of the carriage 18 about an axis perpendicular to the sliding surface 35. In addition, it is possible to generate a turning force which causes the carriage 18 to be pressed against the sliding surface 35, by at least one of the abutment portions 55, of which an abutment position on the carriage 18 is located further on an upper side in a direction perpendicular to the sliding surface 35 than the connection portion 61.

The embodiment described above may be modified as described below.

In the embodiment described above, the slide body 52 may be configured such that a portion having the cap member 57 and a portion having the abutment portion 55 are formed to be separate. An example of the modified example described above will be described with reference to FIG. 16. The same reference numerals and letters are given to the components illustrated in FIG. 16, which are the same as those in the embodiment described above, and descriptions thereof will not be repeated.

Figure 16:
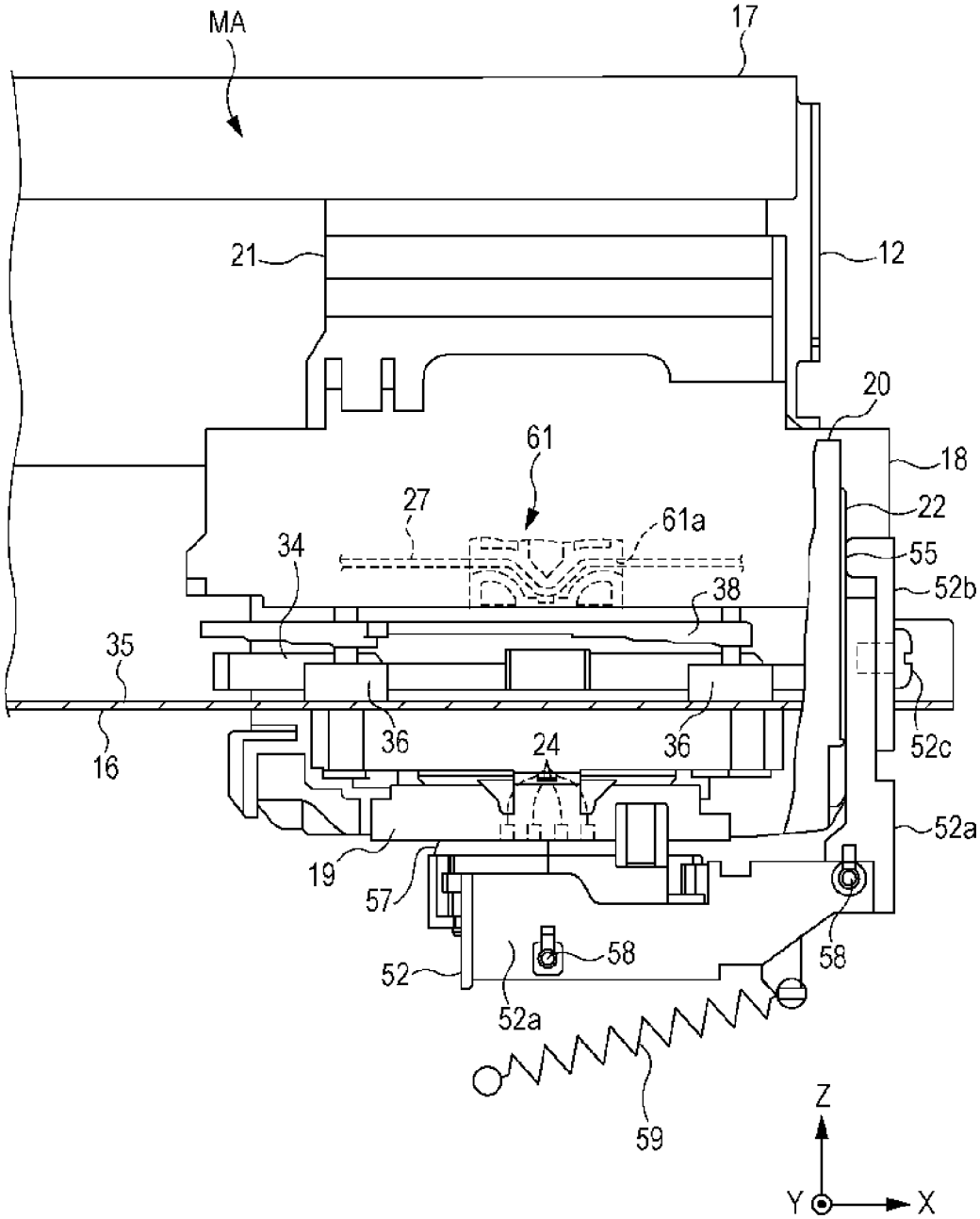
FIG. 16 is a schematic view illustrating a slide body in which the carriage and the abutment portion are formed to be separate.

In this modified example, the abutment portion 55 is provided on a second member **52*b* that is provided in the slide body 52 to be separated from a first member 52*a* constituting a holding portion which holds the cap member 57 via an elastic member and that is mounted on the first member 52*a* to be slidable in at least the up and down direction, relative to the first member 52*a*, as illustrated in FIG. 16. The second member 52*b* moves in the up and down direction, relative to the first member 52*a* so as to adjust the position of the abutment portion 55 which abuts on the portion to be abutted 22 of the carriage 18, and then the second member 52*b* is fixed to the first member 52*a* using, for example, a fixing member 52*c***, such as a screw.

According to the modified example, it is possible to obtain the following effect, in addition to the effects (1) to (4) of the embodiment described above.

(5) It is possible to adjust a distance, in terms of the vertical direction, between the abutment portion 55 and the sliding surface 35 in a state where the cap member 57 abuts on the liquid ejecting head 19. Thus, it is possible to easily control the turning force acting on the carriage 18 to cause the carriage 18 to be pressed against the sliding surface 35.

In the embodiment described above, the slide body 52 may be configured such that one abutment portion 55 abuts on the carriage 18. Furthermore, in a case where a plurality of abutment portions 55 are provided, when the cap member 57 abuts on the liquid ejecting head 19, at least one (for example, the first abutment portion **55*a*) of the plurality of abutment portions 55 may abut on the carriage 18, in terms of a direction perpendicular to the sliding surface 35, at the same position as the connection portion 61. As a result, it is possible to prevent a turning force which causes the carriage 18 to be separated from the sliding surface 35** from being generated.

Alternatively, in a state where the cap member 57 abuts on the liquid ejecting head 19, at least one (for example, the first abutment portion **55*a*) of the plurality of the abutment portions 55 may abut on the carriage 18 at a position which is located further on the anti-gravity direction side of a direction perpendicular to the sliding surface 35 than the connection portion 61. As a result, it is possible to generate a turning force which causes the carriage 18 to be pressed against the sliding surface 35**.

In the embodiment described above, when the abutment portion 55 of the slide body 52 abuts on the carriage 18, that is, when the slide body 52 is located in the head facing position, an abutment position of the abutment portion 55 on the carriage 18 may be located, in terms of a direction perpendicular to the sliding surface 35, at the same position as the connection portion 61 or be located further in the anti-gravity direction side than the connection portion 61.

In the embodiment described above, the printer 11 does not necessarily include the position adjusting mechanism which adjust the position of the carriage 18 so as to adjust the distance between the paper sheet P and the liquid ejecting head 19. In a case where, for example, printing is performed on the paper sheet P of which a thickness is always constant, the position adjusting mechanism is not necessary.

In the embodiment described above, the carriage 18 may be configured such that a driving force from the carriage motor 28 is transmitted through a gear mechanism, such as a rack-pinion mechanism, instead of the driving belt 27. In this case, a moving force receiving portion is a part of the carriage 18, to which the driving force from the carriage motor 28 is transmitted.

In the embodiment described above, the main guiding portion 16*a* is configured to have the flat surface. However, the main guiding portion may have a shaft shape. In this case, the sliding contact portion 36 of the carriage 18 may be configured to have a shape corresponding to the main guiding portion having a shaft shape. The reason for this will be described in the following. Even when the sliding contact portion is provided on the carriage 18 to correspond to the main guiding portion having a shaft shape, it is necessary to ensure clearance between the main guiding portion and the sliding contact portion to slide the carriage 18 in a main scanning direction. This causes a problem that, when the carriage 18 abuts on the slide body 52, the carriage 18 rotates, as similar to the embodiment described above.

In the embodiment described above, a vertical position of the carriage 18 may be adjusted, by the cam member 38, in two steps, three steps, five steps or more. Alternatively, the vertical position of the carriage 18 may be adjusted by a cam mechanism having a configuration different from the cam member 38.

In the embodiment described above, the printer 11 may be a so-called on-carriage type printer in which each ink cartridges 32 is mounted on the carriage 18.

In the embodiment described above, a supply source of ink which is liquid ejected from the liquid ejecting head 19 may be an ink receiving body which is provided outside the main body frame 12. In a case of the ink cartridges 32 of a type in which the ink cartridges 32 is provided inside the main body frame 12, the capacity of ink received by the cartridge is limited. Thus, upon comparison with the ink cartridges 32, when an ink receiving body is provided outside the main body frame 12, it is possible to receive more ink. Therefore, it is possible to perform printing on the large number of paper sheets P.

An example of a configuration in which an ink receiving body is provided outside the main body frame 12 will be described with reference to FIG. 17.

Figure 17:
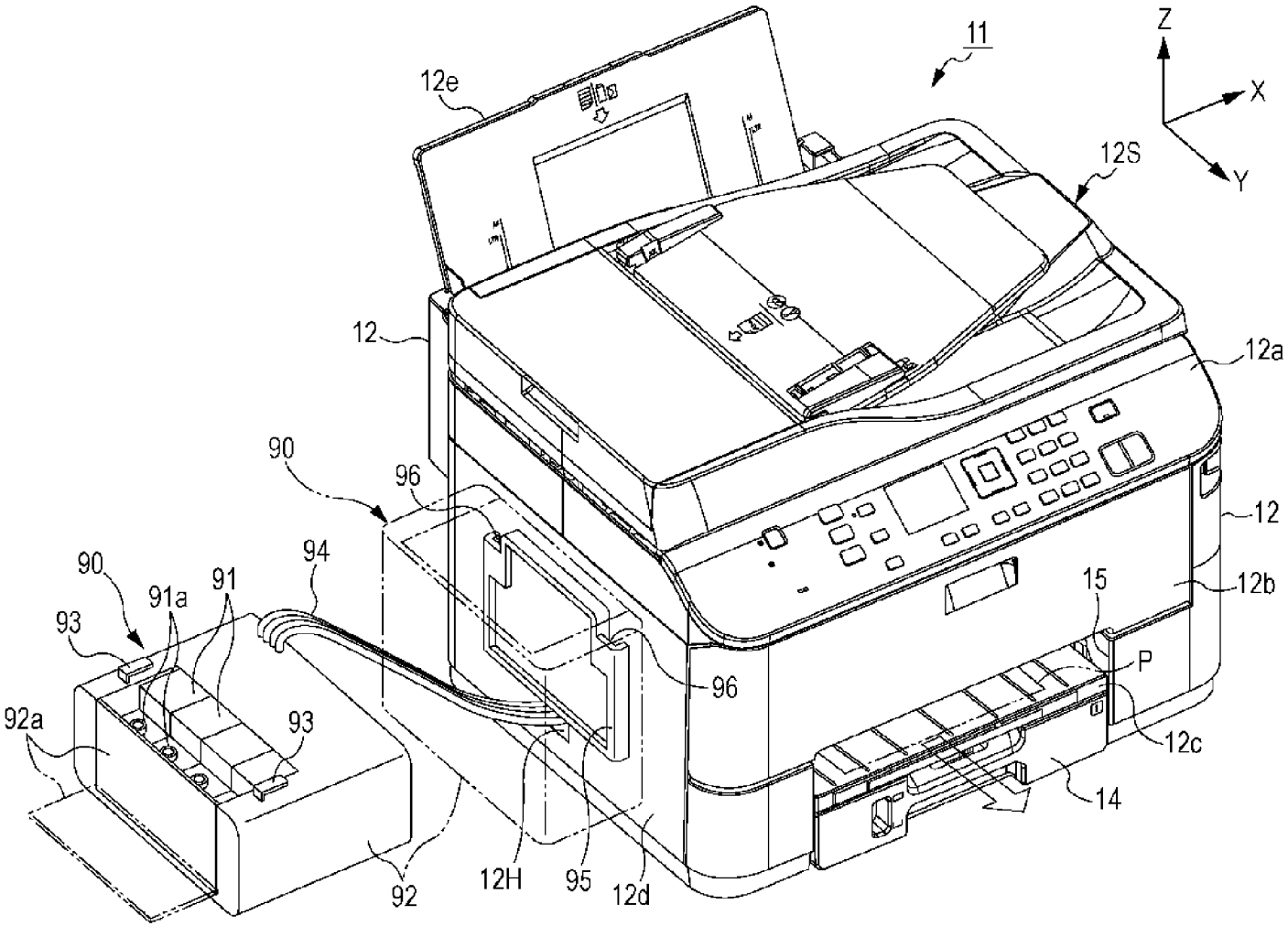
FIG. 17 is a perspective view of a printer according to a modified example, in which ink is supplied from an ink tank provided outside a main body frame.

The printer 11 of this modified example is a multifunction printer including a scanner unit 12S as an image reading apparatus which is mounted to be connected to the main body frame 12 in the anti-gravity direction (in the up direction), as illustrated in FIG. 17. On the main body frame 12, an operation panel 12*a* which is operated by a user when performing a printing operation of the printer 11 is provided on an upper side in the front direction which is a discharging direction (which is illustrated by the white arrow in FIG. 17) of the printed paper sheet P. Furthermore, in the main body frame 12, a front cover 12*b* is openably and closably mounted below the operation panel 12*a*.

An opening portion 15 is formed below the front cover 12*b*. A discharged paper receiving base 12*c* through which the paper sheet P is discharged outside the main body frame 12 is installed in the opening portion 15. A paper sheet cassette 14 in which the paper sheets P are received in a stacked state is provided below the discharged paper receiving base 12*c*. Furthermore, a mount tray 12*e* on which the paper sheet p is mounted is provided on a rear side of the main body frame 12 and the paper sheet P mounted on the mount tray 12*e* is transported over the support base 13.

In the printer 11, an ink tank 90 as an example of a liquid receiving body in which ink fed to the liquid ejecting head 19 is received is provided outside the main body frame 12, that is, on a frame side surface 12*d* of the main body frame 12, which is located on a left side when viewed from a front side, as illustrated by the two-dot chain line in FIG. 17. In the ink tank 90, four ink cases 91 are received in a tank case 92 having a substantially rectangular shape. Four kinds of ink (for example, cyan ink, magenta ink, yellow ink, and black ink) are received in the respective ink cases 91. The other end sides of four ink supplying tubes 94 which are an example of a liquid supplying tube and of which one end sides are connected to the respective ink tanks 90 (the ink case 91) are inserted into the main body frame 12 through a through-hole 12H on the frame side surface 12*d*, which is formed below a fixing plate 95 for fixing the ink tank 90 and are drawn into the main body frame 12. The installed ink supplying tubes function as an ink flow path and each kind of ink is supplied to the liquid ejecting head 19 through the ink supplying tube.

When filling each ink case 91 with ink for replenishment, the ink tank 90 is removed from the fixing plate 95 which is fixed to the frame side surface 12*d* of the printer 11, as illustrated in FIG. 17. Therefore, a filling port 91*a* formed on the ink case 91 is exposed upward. In other words, a pair of hook portions 93 provided on the tank case 92 are pulled out from a pair of hook insertion portions 96 which are provided on the fixing plate 95 and allow the hook portions 93 to be inserted thereinto, and thus the tank case 92 which is mounted on the frame side surface 12*d*, as illustrated by the two-dot chain line in FIG. 17, is removed. Then, if it is necessary, a case lid 92*a* which is provided on the tank case 92 is displaced in a rotating (oscillation) manner, as illustrated by the two-dot chain line in FIG. 17. Accordingly, ink is poured through the exposed filling port 91*a*.

When the ink supplying tubes 94 which supply the ink from the outside of the main body frame 12 to the liquid ejecting head 19 are drawn into the main body frame 12, the ink supplying tubes 94 may pass through a notch portion which is provided on the main body frame 12, instead of the through-hole. Alternatively, a boss portion may be provided to prevent a opening/closing body, such as the scanner unit 12S and the front cover 12*b* which are openably and closably mounted on the main body frame 12, from being completely closed, relative to the main body frame 12. Therefore, the ink supplying tubes 94 may be drawn into the main body frame 12 through a gap formed by the boss portion. In this case, it is possible to ensure supplying of the ink to the liquid ejecting head 19 through the ink supplying tube 94 as a flow path.

The ink supplying tube 94 which supplies the ink from the ink tank 90 functions, for example, as similar to the ink supplying tube 33 illustrated in FIG. 1. Thus, the ink supplying tube 94 guides the ink to the carriage 18 (the valve unit 30) and has a deformation movable portion, as similar to the curved portion 33*a* illustrated in FIG. 1, which deforms in accordance with movement of the carriage 18.

In the embodiment described above, the printer 11 may be an on-carriage type in which the ink cartridge 32 is mounted on the carriage 18. The printer 11 may be a type in which the ink tank 90 is provided inside the main body frame 12 as an apparatus main body. Only a portion in which ink of specific color is received may be disposed outside the main body frame 12.

In the embodiment described above, the ink tank 90 as a liquid receiving body may be a so-called refill type enabling ink to be poured thereinto or may be a so-called pack replacing type in which an ink pack which is a pack filled with ink is replaced.

In the embodiment described above, a plastic film, cloth, metallic foil or the like may be used as a target object, instead of the paper sheet P.

In each embodiment described above, the printer 11 may be a liquid ejecting apparatus that ejects or discharges a liquid aside from ink. Furthermore, the small amount of liquid discharged from the liquid ejecting apparatus includes granule forms, teardrop forms, and forms that pull trails in a string-like form therebehind. In addition, the liquid referred to here can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in a liquid carrier are included as well. Ink, a liquid crystal or the like is exemplified as a representative example of a liquid, in the embodiments described above. In this case, the ink includes a general water-based ink and oil-based ink, aside from various liquid compositions of a gel ink, a hot melt ink or the like. A liquid ejecting apparatus which ejects liquid containing material such as an electrode material or a coloring material in a dispersed or dissolved state, which is used for manufacturing a liquid crystal display, an electroluminescence (EL) display, a surface-emitting display, a color filter or the like is exemplified as a specific example of the liquid ejecting apparatus. In addition, the liquid ejecting apparatus may be a liquid ejecting apparatus for ejecting a living organic material used for manufacturing a biochip, a liquid ejecting apparatus for ejecting a liquid as a sample used as a precision pipette, a printing equipment, a micro dispenser or the like. Further, the liquid ejecting apparatus may be a liquid ejecting apparatus for precisely ejecting lubricant to a precision machine such as a watch or a camera, or a liquid ejecting apparatus that ejects on a substrate a transparent resin liquid such as an ultraviolet curing resin in order to form a minute hemispherical lens (an optical lens) used in an optical communication element or the like. In addition, the liquid ejecting apparatus may be a liquid ejecting apparatus that ejects an etching liquid such as acid or alkali to etch a substrate or the like.

The entire disclosure of Japanese Patent Application No. 2013-124877, filed Jun. 13, 2013 is expressly incorporated by reference herein.

What is claimed is:

1. A liquid ejecting apparatus comprising:

an apparatus main body including a liquid ejecting head that can eject liquid onto a target object through nozzles, a movable body that is movable in a state where the liquid ejecting head is supported thereon, a movement guiding member that has a sliding surface and enables the movable body to move in a scanning direction perpendicular to a vertical direction in a state where the movable body is mounted thereon, a movement mechanism that causes the movable body to move, along the sliding surface, in the scanning direction, and a slide body that has an abutment portion which can abut on the movable body which moves in the scanning direction and has a cap member which can abut on the liquid ejecting head to surround the nozzles in such a manner that the slide body moves along with the movable body in a state where the abutment portion abuts on the movable body, wherein the movable body has a connection portion in which the movable body is connected to the movement mechanism, and wherein, in a state where the cap member abuts on the liquid ejecting head, the abutment portion of the slide body abuts on the movable body at a position which is located, in terms of a direction perpendicular to the sliding surface, at the same position as the connection portion or is located further on an anti-gravity direction than the connection portion.

2. The liquid ejecting apparatus according to claim 1, wherein, while the slide body moves in the scanning direction in a state where the abutment portion of the slide body abuts on the movable body, an abutment position in which the abutment portion abuts on the movable body moves, in terms of a direction perpendicular to the sliding surface, from a position which is located further on a gravity direction side than the connection portion to a position which is located at the same position as the connection portion or is located further on the anti-gravity direction side than the connection portion.

3. The liquid ejecting apparatus according to claim 1, further comprising:

a position adjusting mechanism that adjusts a position of the movable body so as to adjust a distance between the target object and the liquid ejecting head, wherein, in a state where the connection portion is located farthest apart from the sliding surface of the movement guiding member, resulting from a positional adjustment of the movable body by the position adjusting mechanism, when the cap member abuts on the liquid ejecting head, the abutment portion of the slide body abuts on the movable body at a position which is located, in terms of a direction perpendicular to the sliding surface, at the same position as the connection portion or is located further on the anti-gravity direction side than the connection portion.

4. The liquid ejecting apparatus according to claim 1, wherein the slide body has a plurality of the abutment portions that are aligned in a direction which is parallel to the sliding surface and perpendicular to the scanning direction, and wherein, in a state where the cap member abuts on the liquid ejecting head, at least one of the plurality of the abutment portions abuts on the movable body at a position which is located, in terms of a direction perpendicular to the sliding surface, at the same position as the connection portion or is located further on the anti-gravity direction side than the connection portion.

5. The liquid ejecting apparatus according to claim 1, wherein the slide body is configured such that a portion having the cap member and a portion having the abutment portion are formed to be separate.

6. The liquid ejecting apparatus according to claim 1, further comprising:

a liquid supplying tube that guides the liquid, which is fed from a liquid receiving body in which the liquid is received, to the liquid ejecting head and has a deformable portion which can be deformed in accordance with movement of the movable body, wherein at least a part of the liquid receiving body is provided outside the apparatus main body.

* * * * *